US005971136A

United States Patent [19]

Takeda

[11] Patent Number: 5,971,136

[45] Date of Patent: Oct. 26, 1999

[54] TOWER-LIKE TRANSFER DEVICE

[75] Inventor: Mitsuo Takeda, Tokyo, Japan

[73] Assignee: Kabuki Construction Co., Ltd., Tokyo, Japan

[21] Appl. No.: 08/779,026

[22] Filed: Jan. 6, 1997

[30] Foreign Application Priority Data

Jul. 4, 1996 [JP] Japan ..... 8-194010

[51] Int. Cl.[6] ..... B65G 21/10

[52] U.S. Cl. ..... 198/535; 198/702; 198/701; 52/123.1; 52/745.05; 52/127.4

[58] Field of Search ..... 198/535, 701, 198/702; 52/127.3, 127.4, 742.14, 749.1, 749.13, 745.05, 123.1; 264/32, 33; 414/10

[56] References Cited

U.S. PATENT DOCUMENTS

| | | | |
|---|---|---|---|
| 1,225,356 | 5/1917 | Polk | 52/749.13 |
| 1,788,451 | 1/1931 | Clapp | 198/360 |
| 2,862,252 | 12/1958 | Beach | 52/123.1 |
| 3,213,575 | 10/1965 | Boczek | 52/123.1 |
| 3,761,551 | 9/1973 | Ogata et al. | 264/33 |
| 3,778,204 | 12/1973 | Kuck | 425/63 |
| 3,789,565 | 2/1974 | Lindholm | 52/123.1 |
| 4,197,689 | 4/1980 | DeMuth | 52/123.1 |
| 4,374,790 | 2/1983 | McGowan | 264/32 |
| 4,712,697 | 12/1987 | McGowan | 212/189 |

FOREIGN PATENT DOCUMENTS

| | | | |
|---|---|---|---|
| 26475 | 11/1914 | United Kingdom | 52/123 |
| WO 94/23173 | 10/1994 | WIPO | 52/123.1 |
| WO 96/16242 | 5/1996 | WIPO . | |

*Primary Examiner*—Christopher P. Ellis
*Assistant Examiner*—Steven B. McAllister
*Attorney, Agent, or Firm*—Oblon, Spivak, McClelland, Maier & Neustadt, P.C.

[57] ABSTRACT

A tower-like transfer device includes a cylindrical tower post having an upper post portion and a lower post portion constituted by connecting post constituent members of one kind or two kinds or more, a lift installed liftably to the tower post, an upper post lift for lifting the upper post portion, an integration device for integrating the post constituent member between the upper post portion disconnected from the lower post portion and the lower post portion and holding the upper post portion disconnected from the lower post portion in removing the post constituent member at an upper end of the lower post portion and a transfer lift installed liftably to the tower post.

4 Claims, 27 Drawing Sheets

TOWER-LIKE TRANSFER DEVICE

BACKGROUND OF THE INVENTION

1. Field of the Invention

The present invention relates to a tower-like transfer device in which a transfer device for transferring freshly mixed concrete or the like is installed and of which integration and erection, and disintegration and removal are facilitated.

2. Discussion of the Background

There has been known a construction process in which in building a high structure standing on a comparatively narrow area, for example, a chimney, a silo made of concrete or the like, a mold frame for feeding concrete is constructed on a concrete structure which has been successively formed and cured step by step. According to the construction process of such a structure, various devices for forming the mold frame and for feeding concrete are installed on the concrete structure which has been successively formulated and cured step by step while successively relocating their positions.

Typically, a tower crane is installed at a position along the constructed structure whereby various operations of transferring various base materials, formulation of the mold frame and the like are executed.

However, in constructing a high structure by such a process, it is necessary that the operation is executed successively by providing a sufficient curing time period respectively after feeding concrete and it is necessary to successively execute the relocation of the mold frame for feeding concrete and of various operational devices with respect to the concrete structure which is successively formulated and cured.

Furthermore, in building a high concrete structures such as a chimney, a silo or the like by using a tower crane, it is difficult to set the mold frame for feeding concrete and remove the mold frame after curing concrete and it is difficult to smoothly feed concrete to the mold frame. In extending the tower, it has been necessary to attach successively tower constituent members onto the top end portion of the tower. Therefore, a bucket lifting means such as a winch or the like cannot be installed onto the top portion of the tower.

SUMMARY OF THE INVENTION

It is an object of the present invention to provide a tower-like transfer device having a lift installed liftably to a tower post with an integration device for integrating post constituent members into the tower post in order to erect the post and for removing the post constituent members from the middle portion of the tower post, so that various devices such as a winch and the like installed at the upper portion of the tower post are moved up as the constituent members installed.

In order to achieve the above-described object, according to a first aspect of the present invention, there is provided a tower-like transfer device comprising a cylindrical tower post A including an upper post portion A" and a lower post portion A' made of a plurality of post constituent members, a lift B installed liftably to the tower post, an upper post lifting means V for lifting the upper post portion and a transfer means D installed liftably to the tower post A.

According to a second aspect of the present invention, there is provided the tower-like transfer device according to the first aspect, wherein the upper post portion A" is provided with a discharge port Ab for discharging an object of transfer from the transfer means D.

According to a third aspect of the present invention, there is provided the tower-like transfer device according to the first aspect, wherein the transfer means D installed to the tower post A is the transfer means D for freshly mixed concrete, the lift B is provided with a horizontally swiveling boom F and the boom F is provided with a belt conveyor device G and wherein the freshly mixed concrete H transferred by the transfer means D is transferred from a discharge chute 105 installed at the discharge port Ab of the tower post A to a rotary feeder J installed above the boom F and the freshly mixed concrete H is transferred from the rotary feeder J to a conveyor belt 130 in the belt conveyor device G.

DETAILED DESCRIPTION OF PREFERRED EMBODIMENTS

A detailed explanation will be given of respective embodiments with respect to a typical tower-like transfer device according to the present invention.

As shown in tower-like transfer device according to the present FIGS. 103, the embodiment for constructing a cylindrical structure K, is provided with the cylindrical tower post A having the upper post portion A" and the lower post portion A' that is constituted by connecting the post constituent members of one kind or two kinds or more. The lift B is also installed liftably to the tower post A, as is the upper post lifting means V for lifting the upper post portion A" on the integration device E as shown in FIGS. 12A–12D, for integrating the post constituent member between the upper post portion A" disconnected from the lower post portion A' and the lower post portion A' and the transfer means D.

According to the tower-like transfer device constituted as described above, the tower post A can be extended upwardly irrespective of the configuration of the upper post portion A", without relocating various transfer means such as a winch and the like installed to the upper post portion A" or without changing the installation thereof. Similarly, the tower post A can successively be removed member by member such that the various facilities and the like stay installed to the upper portion A".

Figure 4:
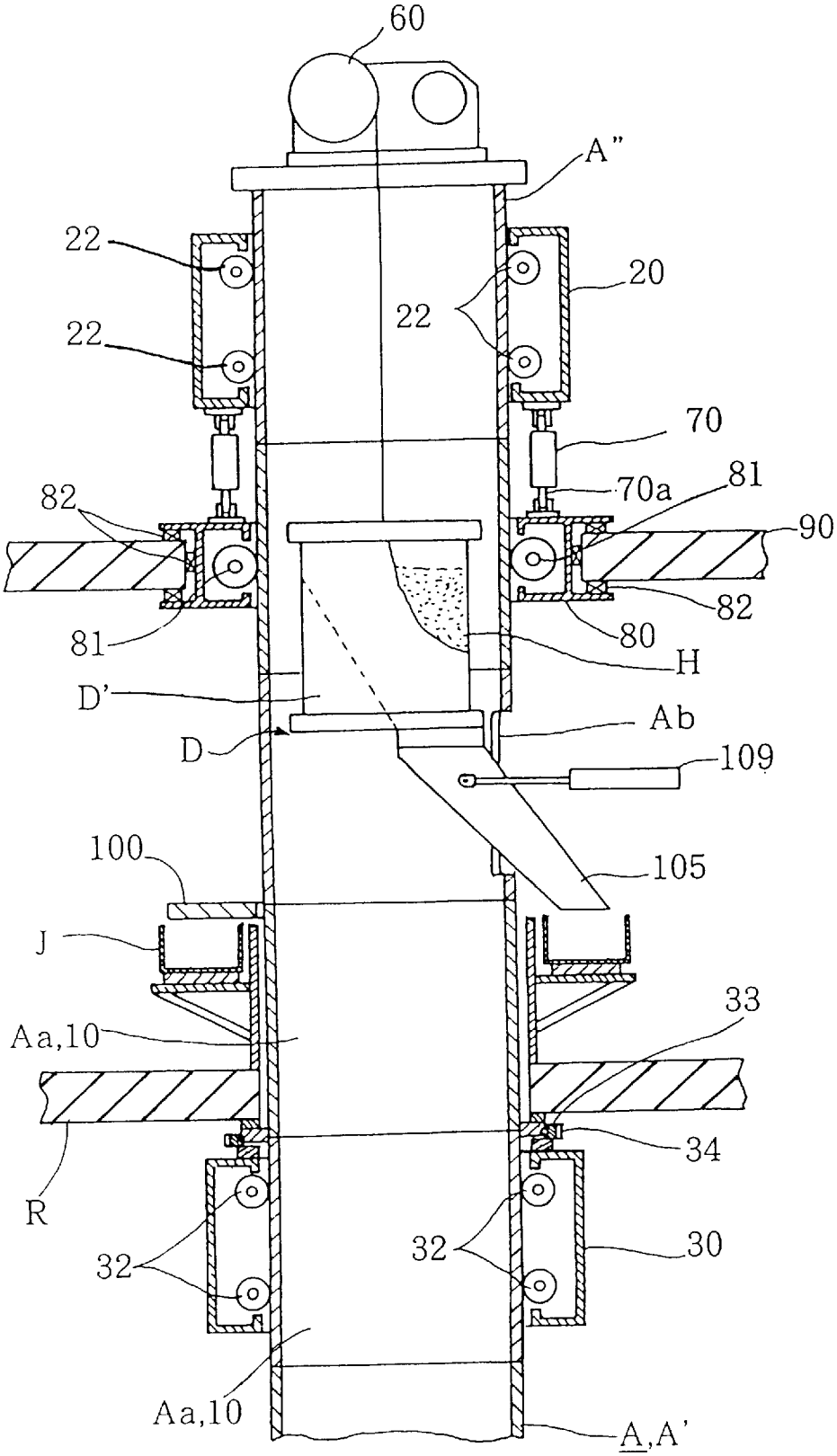
FIG. 4 is a sectional view showing essential constituent parts at the upper portion of the device in view from the front side.

Referring now to FIG. 4, another typical embodiment of the present invention is the tower-like transfer device according to the above-described constitution wherein the upper post portion A" is provided with a discharge port Ab for an object of transfer from the transfer means D installed to the tower post A.

According to the tower-like transfer device constructed as above, even if the tower post A constituting the tower-like transfer device is extended or contracted, the object of transfer that is transferred to the tower post A can always be taken out from the discharge port remaining in the same direction and is used or can be moved in and transferred.

In respect of the tower-like transfer device in accordance with the above-described construction, the transfer means D installed to the tower post A is the transfer means for freshly mixed concrete H, the lift B is provided with the boom F that is horizontally swiveled and the boom F is provided with the belt conveyor device G. Furthermore, the freshly mixed concrete H that is pulled up by the transfer means D is transferred from the discharge chute 105 installed to the discharge port Ab of the tower post A to the rotary feeder J installed above the boom F and the freshly mixed concrete H is transferred from the rotary feeder J to the belt conveyor 130 in the belt conveyor device G. which is another typical embodiment.

According to the tower-like transfer device constructed as above, the freshly mixed concrete H can smoothly be supplied from a lower portion of the tower-like transfer device successively to higher positions and further to all the portions within a range where the boom F installed to the tower-like transfer device A can be swiveled and relocation of the transfer device and the like such as a bucket or the like is not necessary in either of extending the tower post A and in contracting thereof accompanied by the partial removal operation.

In operation, the tower post A constituting the tower-like transfer device is installed substantially at the central portion of the cylindrical structure K such as a chimney or the like made of reinforced concrete that is constructed by using the tower-like transfer device.

The tower post A constituting the tower-like transfer device utilizes a foundation 1 of the cylindrical structure K and is constituted by the lower post portion A' erected on the foundation 1 and the upper post portion A" connected onto the lower post portion A'. Further, the lower post portion A' constituting the tower post A is constructed typically by preparing cylindrical bodies 10 arranged in a predetermined length. For example, the steel cylindrical bodies 10 are used as the post constituent members Aa and successively and continuously stacking the respective cylindrical bodies on a base member 2 integrated to the foundation 1 which has been installed previously at the installing position.

The cylindrical member 10 is preferably used as the post constituent member Aa attachable and detachable in respect of the lower post A'. Cylindrical member 10 is preferably provided with flanges 10*a* for butting connection at its top and bottom opening edges. The lower post A' can be formulated as a cylindrical column by bringing the flanges 10*a* to a butting state and fastening them by fasteners 13 of bolts, nuts or the like, as shown in FIGS. 10, 11 and 12A–12F.

Referring again to FIGS. 1–4, the tower post A having the upper post portion A" and the lower post portion A', is provided with the first lift B integrated liftably to the upper portion of the tower post A by a pair of top and bottom lift frames 20 and 30 constituting lifting means, which can be displaced relative to each other, and the second lift L disposed below the first lift B and integrated liftably to the tower post A similarly by a pair of lift frames 40 and 50 constituting lifting means, which can be displaced relative to each other.

The tower post A having the first lift B and the second lift L, is provided with the lower post portion A' which is constructed in this illustrated example as a portion of the tower post A comprised of a series of cylindrical bodies 10 erected on the base member 2. The upper post portion A" disposed above the lower post portion A', can be integrated to the lower post portion A' and which can be raised and separated from the lower post portion A' as necessary, wherein a new one of the post constituent member Aa can be integrated between the lower post portion A' and the upper post portion A", or the post constituent member Aa can be removed from the upper end portion of the lower post portion A'.

The upper post portion A" is provided with a winch device 60 at its upper end portion and the transfer means D hung in the cylindrical portion of the constituted tower post A, especially the transfer means D of a bucket type in this illustrated example can be lifted by the winch device 60.

The first lift B installed to the tower post A is provided with the upper lift frame 20, the lower lift frame 30, the swiveling body R, the rotary feeder J, the auxiliary stage 80, a rotary frame 90, the operation stage 100 and the like. Further, according to the pair of top and bottom lifting means installed to the first lift B, the lower lift frame 30 as one of the lifting means constituting the lift B is integrated to the upper portion of the lower post portion A' in the tower post A and the upper lift frame 20 as the other one of the lifting means is integrated to the upper post portion A" in the tower post A.

The first lift B installed to the tower post A is provided with the lower lift frame 30 installed liftably to the tower post A, particularly to the upper portion of the lower post portion A' and the upper lift frame 20 installed liftably to the upper post portion A" as the lifting means of the first lift B. The first lift B is integrated to the tower post A in a movable fashion in the upward direction or downward direction by locking means 21 and 31 of the respective lift frames 20 and 30, and by extracting and contracting cylinder shafts 70*a* in respective hydraulic cylinder devices 70 as jacking means.

According to the lifting operation of the first lift B, by the respective locking means 21 and 31 of the respective lift frames 20 and 30 and the extracting and contracting operation of the cylinder shafts 70*a* of the respective hydraulic cylinder devices 70, the lower lift frame 30, the swiveling body R having the boom F and the auxiliary stage 80 installed above the swiveling body R and installed liftably to the tower post A, are integrally lifted along with the upper lift frame 20.

A further specific explanation will be given of the example of attachment relationship. The lower lift frame 30 is installed to the upper portion of the lower post portion A' in the tower post A movably in the up and down direction, the swiveling body R is installed rotatably in respect of the lower lift frame 30 with the tower post A as the center of rotation and the rotary feeding J is integrally installed onto the swiveling body R to surround the tower post A.

Further, the upper lift frame 20 is liftably installed to the tower post A, especially to the upper post portion A", the auxiliary stage 80 disposed below the upper lift frame 20 and connected to the upper lift frame 20 by the respective hydraulic cylinder devices 70, is liftably installed to the tower post A, especially to the upper post portion A" similar to the upper lift frame 20 and the rotary frame 90 integrated rotatably to the outer periphery of the auxiliary stage 80, is integrated to the swiveling body R by support rods 91.

Further, the operation stage 100 for installing a post transfer means E is hung by respective rods 101 from the auxiliary stage 80 integrated to the rotary frame 90 and liftable in respect of the tower post A whereby the operation stage 100 can be moved in the upper direction or lower direction in respect of the tower post A along with the auxiliary stage 80 and the like constituting the first lift B.

Figure 13:
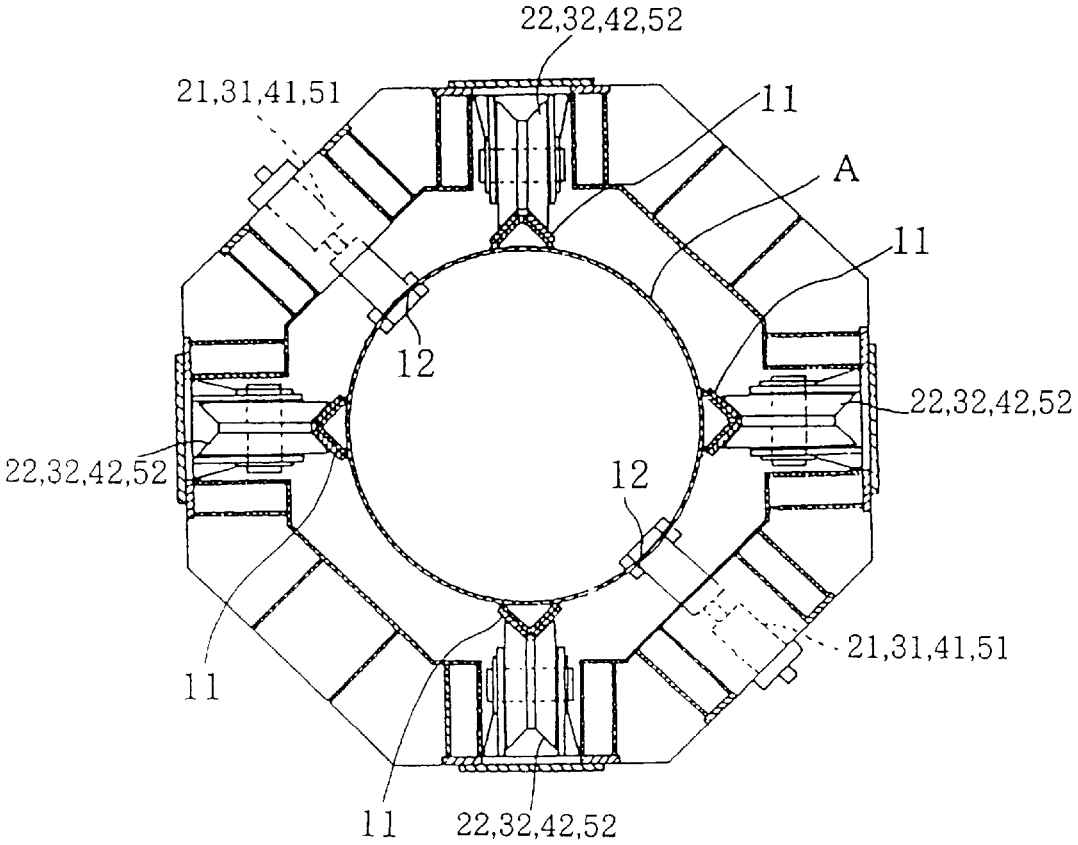
FIG. 13 is a plane sectional view showing respective lifting means of the device.

Referring also to FIG. 13, the lift frames 20 and 30 and the auxiliary stage 80 which are liftably installed to the tower post A, are provided with a constitution liftable along the cylindrical bodies 10 constituting tower post A without play, that is, fitting portions in a circular hole shape surrounding the cylindrical bodies 10 and are provided with respective guide rolls 22, 32 and 81 each having rolling faces in a V-like shape to pinch both faces of a guide rail 11 installed in the up and down direction of the tower post A and projected in an inverse-V-like shape.

The lift frames 20 and 30 are provided with the respective locking means 21 and 31 for locking the lift frames 20 and 30 to the tower post A.

Figure 5:
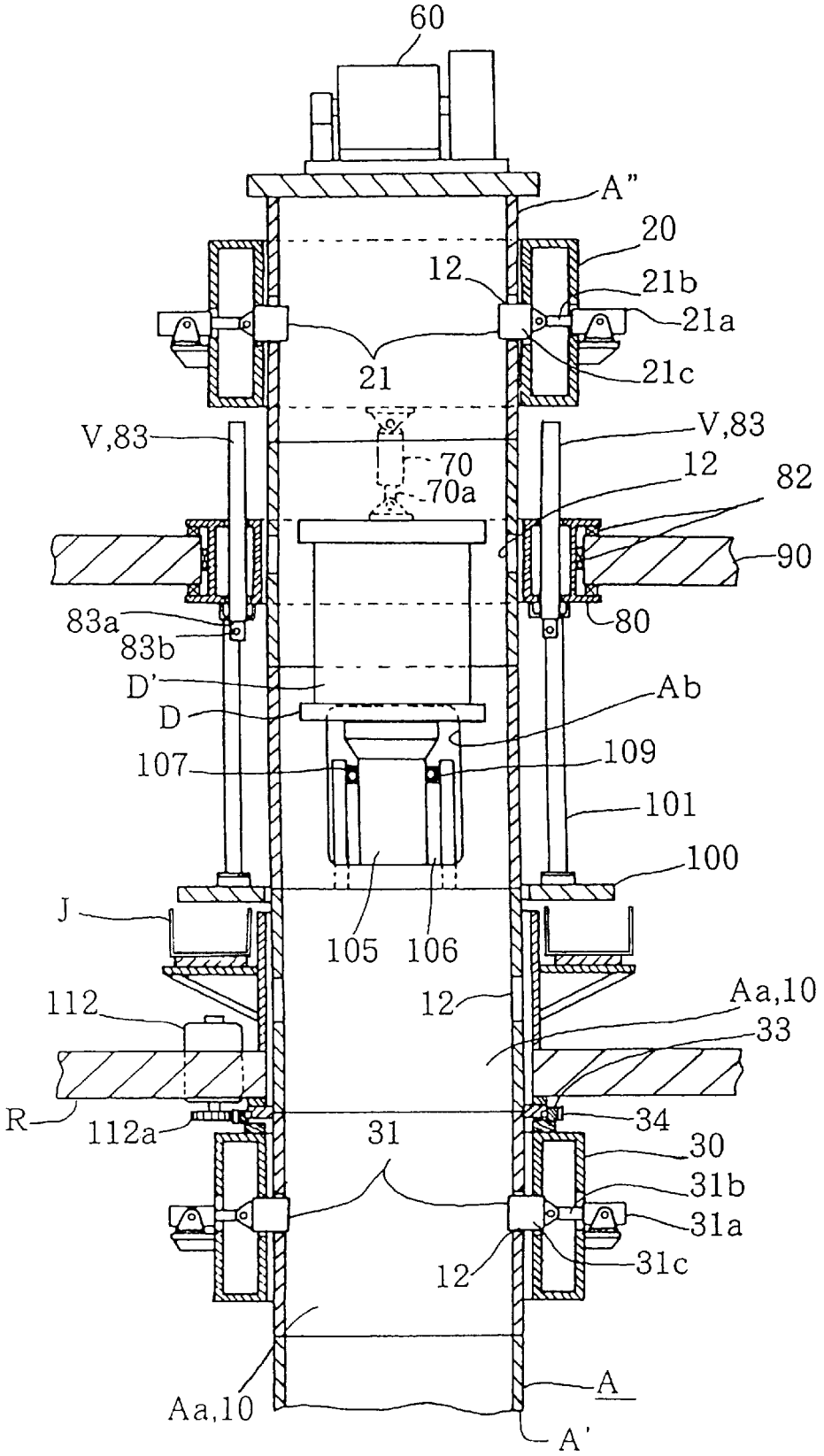
FIG. 5 is a sectional view showing essential constituent parts at the upper portion of the device in view from the side direction.
Figure 6:
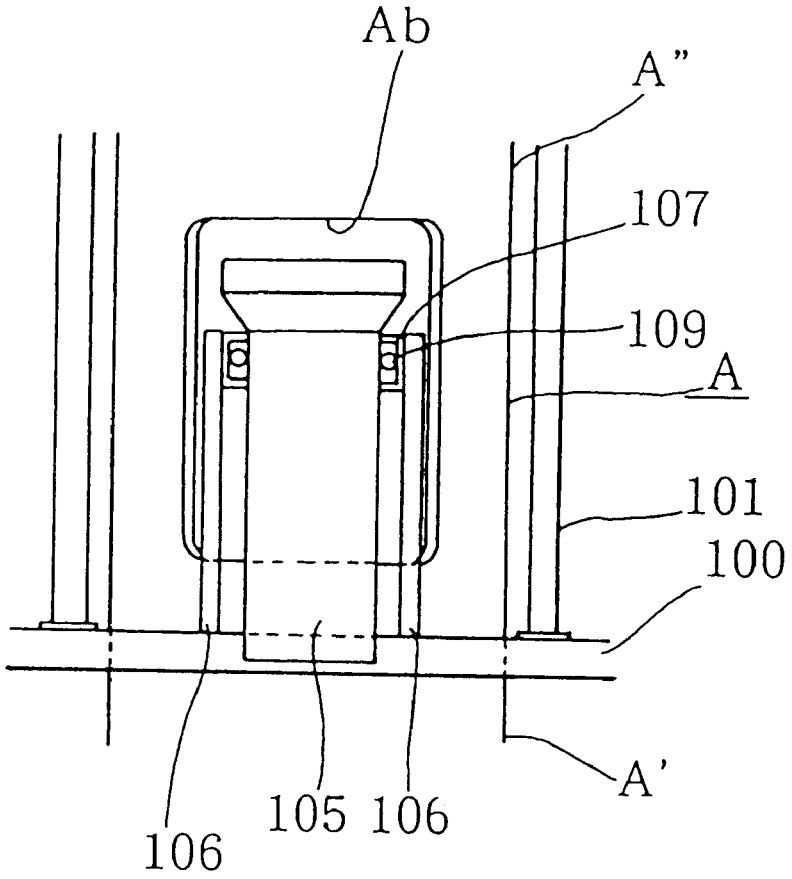
FIG. 6 is a side view of essential portions of a discharge port in the device.

Referring now to FIG. 5, the respective locking means 21 and 31 installed to the respective lift frames 20 and 30 are constituted by respective hydraulic cylinders 21*a* and 31*a* for locking and lock sticks 21*c* and 31*c* installed to the front ends of cylinder shaft 21*b* and 31*b* in the hydraulic cylinders 21*a* and 31*a*, which are installed to the respective lift frame 20 and 30. The locking operation can be executed by inserting the lock sticks 21*c* and 31*c* into respective lock holes 12 installed to the tower post A.

With regard to the hydraulic cylinder devices 70 installed between the auxiliary stage 80 held by the rotary frame 90 installed above the swiveling body R and the upper frame 20, the cylinder shafts 70*a* stay contracted typically in the ordinary state under which the respective lock sticks 21*c* and 31*c* of the locking means 21 and 31 in the respective lift frames 20 and 30, are inserted into the lock holes 12 of tower post A. Accordingly, under a state where the lock sticks 21*c* in the upper lift frame 20 are drawn out of the lock holes 12 in the tower post A, the post constituent member Aa is put between the lower post portion A' and the upper post portion A". Further, the upper lift frame 20 is pushed up along the tower post A in an extended state by extracting the cylinder shaft 70*a* and the respective lock sticks 21*c* of the locking means 21 in the upper lift frame 20 under the pushed-up state, are inserted into the lock holes 12 in the tower post A.

Under such a state, the lock sticks 31*c* of the locking means 31 in the lower lift frame 30, are drawn from the lock holes 12 in the tower post A whereby the mutual locking state is released and the cylinder shafts 70*a* are retracted whereby the lower lift frame 30, the swiveling body R, the auxiliary stage 80 and the like installed to the lower lift frame 30 in series, are moved upwardly along the tower post A. At a location where the upward movement is finished, the lock sticks 31*c* of the locking means 31 in the lower lift frame 30, are inserted into the lock holes 12 of the tower post A which are prepared to open at the elevated position whereby the lower lift frame 30 is fastened to the tower post A.

Further, in lowering the first lift B to the lower portion of the tower post A, for example, the locking means 31 of the lower lift frame 30 are relieved from the lock holes 12 of the tower post A and the cylinder shafts 70*a* of the hydraulic cylinder devices 70 are extracted whereby the lower lift frame 30 and the swiveling body R, the auxiliary stage 80 and the like integrated to the lower lift frame 30, are moved downwardly along the tower post A. At a position where the movement is finished, the lower frame 30 is locked by inserting the lock sticks 31*c* of the locking means 31 into the lock holes 12 in the tower post A.

Next, the locking by the lock sticks 21*c* of the locking means 21 in the upper lift frame 20 in respect of the lock holes 12 in the tower post A, is relieved and the cylinder shafts 70*a* are retracted whereby the upper lift frame 20 is lowered to a lower portion along the tower post A and the locking state is again achieved by inserting the lock sticks 21*c* of the locking means 21 into the lock holes 12 in the tower post A.

Under this state, the post constituent member Aa installed onto the topmost end of the lower post portion A' in the tower post A is removed from the lower post portion A' and the upper post portion A" is integrated again onto the upper end of the lower post portion A' where the post constituent member Aa has been removed whereby the first lift B can be lowered and the cower post A can partially be removed.

Referring again to FIGS. 1–3, the swiveling body R is rotatably attached to the first lift B installed liftably to the tower post A, particularly to the portion thereof above the lower lift frame 30 via a rotational bearing means. As shown in FIG. 5, the swiveling body R is made rotatable by bringing a pin gear 112*a* installed to a rotational shaft of a drive motor 112 in mesh with a chain with attachment 34 that is fixed under tension to a disc body 33 installed to a rotational bearing means 111' in the circumferential direction.

Thus, the swiveling body R is provided with the boom F, explained later, and the rotational feeder J supplying the belt conveyor device G in the boom F with the freshly mixed concrete H.

Successively, the auxiliary stage 80 is integrated to the tower post A, particularly to the upper lift frame 20 integrated to the upper side of the upper post portion A" by the hydraulic cylinder devices 70 and the rotary frame 90 is rotatably integrated to the auxiliary stage 80 via a rotational bearing means 82 in the circumferential direction of the outer periphery.

The rotary frame 90 rotatably integrated to the auxiliary stage 80, is integrated to the swiveling body R by the support rods 91 and is rotated around the auxiliary stage 80 along with the rotation of the swiveling body R.

Next, the auxiliary stage 80 that is made liftable in respect of the tower post A along with the respective members of the first lift B, supports the operation stage 100 with 101. The integration and the removal of the post constituent member Aa to and from the tower post A can be executed by utilizing the operation stage 100.

Figure 2:
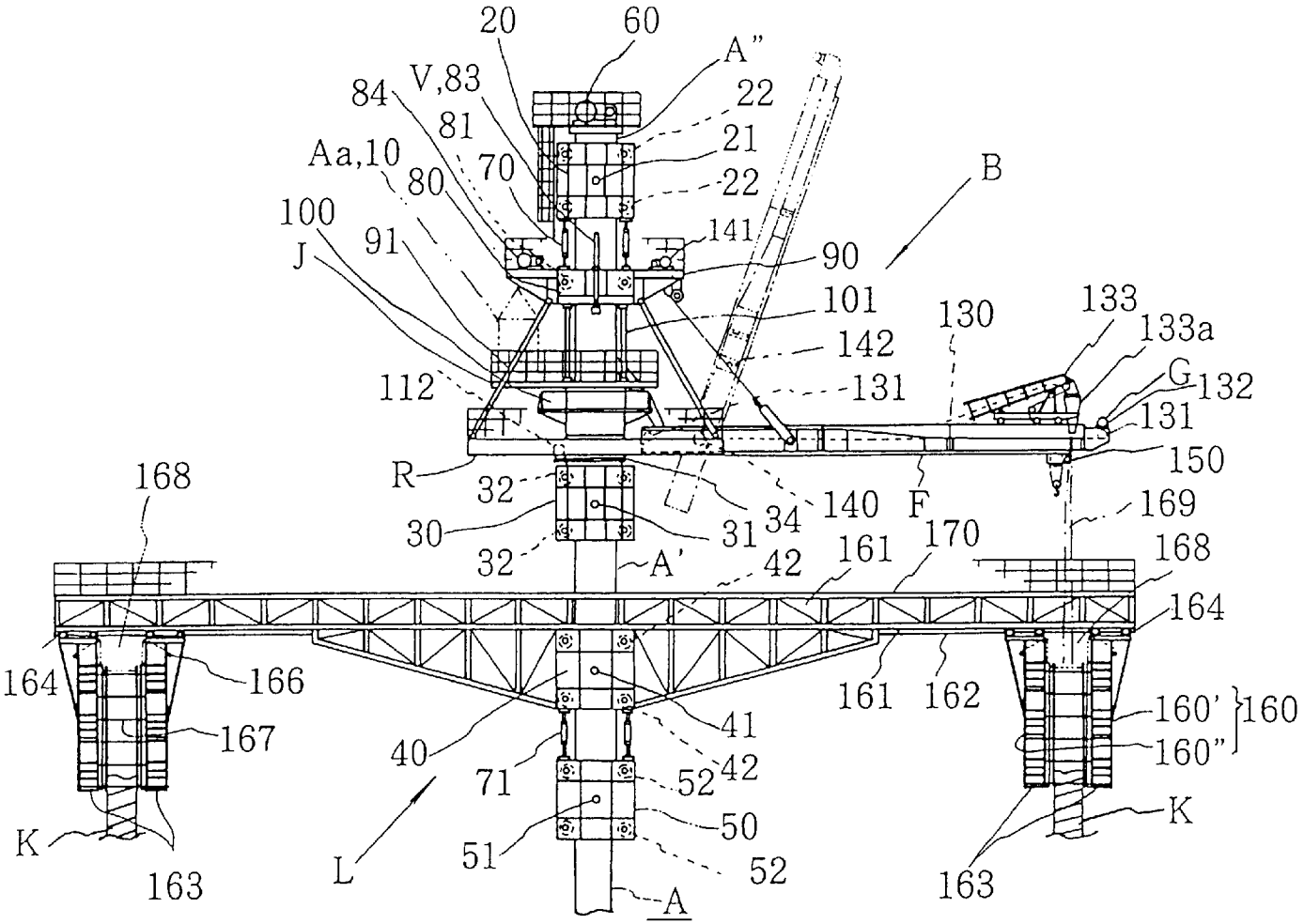
FIG. 2 is a partially broken front view showing the upper portion of the device.
Figure 3:
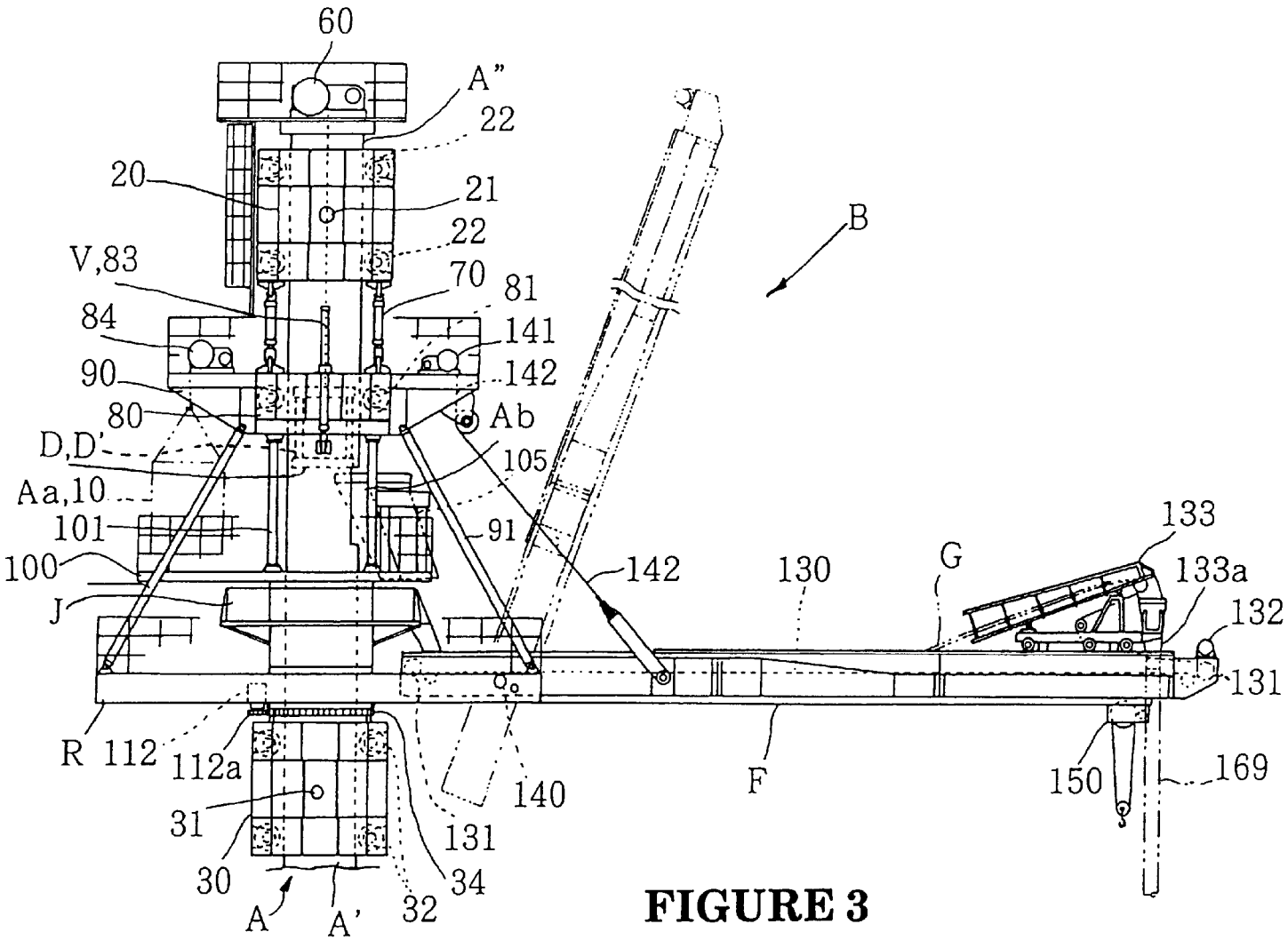
FIG. 3 is a front view showing the upper portion of the device.

As shown in FIGS. 2, 3, and 5, a pair of hydraulic cylinder devices 83 for holding and lifting the upper post portion A" are installed to the auxiliary stage 80 constituted as described above. The pair of hydraulic devices 83 are configured to pull upwardly the upper post portion A" separated from the lower post portion A' and provide a space capable of receiving the post constituent member Aa between the pulled-up upper post portion A" and the upper end portion of the lower post portion A', and can remove the uppermost post constituent member Aa at the lower end of the upper post portion A" from the lower post portion A' while holding the upper post portion A".

As seen in FIGS. 10 and 12A–12D, a carrier 102 used as the post transfer means E used in integrating and removing the post constituent member Aa, is movably installed on the above-described operation stage 100 along guide rails 103. The post constituent member Aa mounted onto the carrier 102, is then transferred to the space provided between the lower post portion A' and the upper post portion A" and the post constituent member Aa to be removed from the tower post A can thereby be discharged from the space.

The post constituent member Aa for integrating and disintegrating the tower post A using the post constituent members Aa, is the same as the post constituent member Aa which has been explained as a constituent member of the tower post A. Explaining in regard thereto again, the post constituent member Aa is constituted as a cylindrical body 10 made of steel or the like, provided with attaching means such as attaching flanges 10*a* at the upper end and the lower end thereof, and can be integrated to the upper end of the lower post portion A' and the lower end of the upper post portion A" by the fastening means 13 such as bolts, nuts or the like.

As has been explained above, the lower post portion A' constituting the tower post A, can be constructed by utilizing the foundation 1 for the cylindrical structure K, utilizing the base member 2 and the like installed to the foundation 1 and successively connecting the respective post constituent members Aa which are used in erection.

With regard to the construction of the lower post portion A', the lower post portion A' may be constructed by constructing a corresponding portion from the lower side of the tower post A by using a cylindrical body, not illustrated, having pertinent length and shape other than those of the post constituent member Aa and thereafter successively connecting the post constituent members Aa onto the constructed portion of the tower post.

As seen in FIGS. 4 and 5, the upper post portion A" constituting the tower post A along with the lower post portion A', is constituted as a comparatively long cylindrical body having the discharge port Ab for an object of transfer at the lower portion thereof and is provided with the winch device 60 at its upper end portion.

In feeding the freshly mixed concrete H by moving the first lift B upwardly in respect of the tower post A, the discharge port Ab in the upper post portion A", is opened at the operational position of the chute 105 installed to the operation stage 100 by which the upper post portion A" can effectively be used in the operational space at the operation stage 100 and the upper side thereof is firmly held by the upper lift frame 20 and the auxiliary stage 80 under such a state.

Next, an explanation will be given of the procedure of integrating the post constituting member Aa to the tower post A.

Referring again to FIGS. 5, 10, 11 and 12A–12F, prior to integrating the post constituent member Aa to the tower post A, the lock sticks 21*c* of the locking means 21 in the upper lift frame 20 are drawn from the lock holes 12 in the tower post A whereby the tower post A is unbound by the upper lift frame 20.

Next, the post constituent member Aa hung by a winch device 84 installed to the auxiliary stage 80, is mounted onto the carrier 102 prepared on the operation stage 100.

The cylinder shafts 83*a* of the hydraulic cylinder devices 83 are then extracted downwardly, brackets 83*b* installed to the shaft ends are attached to the upper post portion A" and the fasteners 13 connecting the upper post portion A' and the post constituent member Aa at the uppermost stage of the lower post portion A' are removed.

Under this state the cylinder shafts 83*a* are retracted, the upper post portion A" is pulled up, a gap is produced between the lower post portion A' and the upper post portion A", the post constituent member Aa along with the carrier 102 are transferred into the gap by utilizing the guide rails 103 and under a state where the cylinder shafts 83*a* are more or less extracted, the flange 10*a* at the upper end of the transferred post constituent member Aa, is connected to the flange 10*a* at the lower end of the upper post portion A" by using the fasteners 13.

Next, the carrier 102 is drawn out of the gap, the cylinder shafts 83*a* are more or less extracted, the flange 10*a* at the lower end of the post constituent member Aa which has been transferred into the gap, is connected to the flange 10*a* at the upper end of the lower post portion A' by using the fasteners 13 and the brackets 83*b* of the hydraulic cylinder devices 83 are removed from the upper post portion A".

Thus, the post constituent member Aa is integrated between the lower post portion A' and the upper post portion A", and these portions are fixed to each other and the brackets 83*b* of the hydraulic cylinder devices 83 are removed in this way, whereby the first lift B can be lifted and the first lift B is moved upwardly by the process described above.

In disintegrating, or dismantling the tower post A, after recognizing that the brackets 83*b* of the hydraulic cylinder devices 83 have been removed from the upper post portion A", the first lift B is moved downwardly by the above described procedure and the locking means 21 of the upper lift frame 20 is released.

Under a state where the hydraulic cylinder shaft 33*a* are retracted, the brackets 83*b* are attached to the lower side of the upper post portion A" and the fasteners 13 connecting the post constituent member Aa to be removed and the post constituent member Aa of the lower post portion A' having the next order of removal, are removed.

Under this state the upper post portion A" and the post constituent member Aa to be removed are more or less pulled up by using the hydraulic cylinder devices 83, the carrier 102 is put beneath the post constituent member Aa to be removed, the fasteners 13 between the upper post portion A" and the post constituent member Aa are removed and the post constituent member Aa is drawn out to the side of the operation stage 100 by the carrier 102.

In this way the upper post portion A" from which the post constituent member Aa has been removed, is brought into contact with the upper end of the lower post portion A' again by extracting the cylinder shafts 83*a* of the hydraulic cylinder devices 13 whereby the upper post portion A" and lower post portion A' are integrated.

Figure 21:
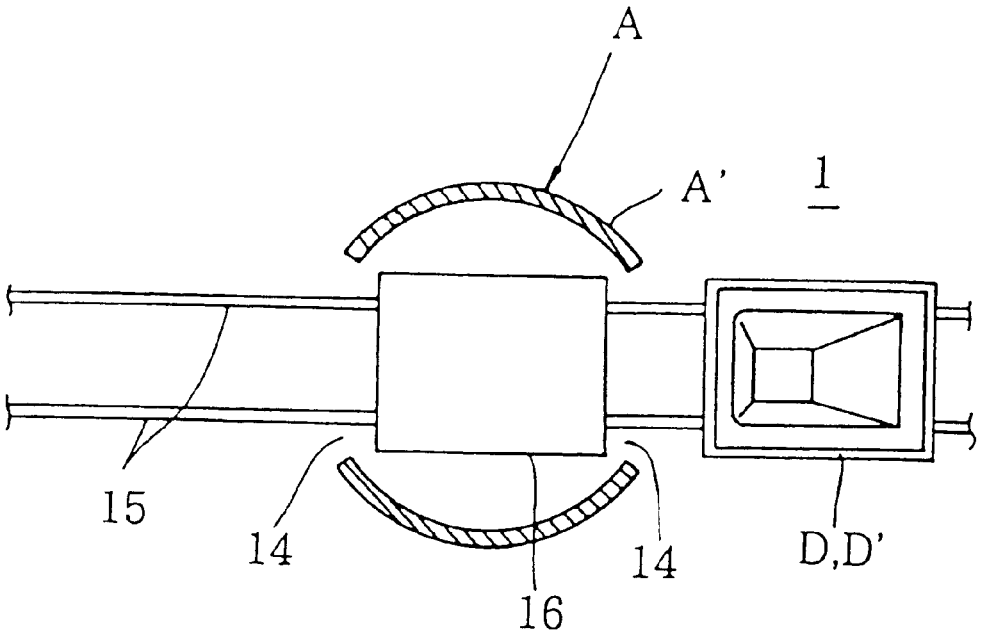
FIG. 21 is a horizontal sectional view of the lower portion of the device.

As seen in FIG. 21, the tower post A constructed as described above, is provided with a pair of openings 14 at the lower post portion A'. A pair of rails 15 are laid through the respective openings 14 and a carrier 16 is mounted onto the rails 15. The transfer means D of freshly mixed concrete as a respective member of the transfer means D, particularly a concrete bucket D' in the illustrated example as a typical one of the transfer means D of freshly mixed concrete, is introduced into the tower post A.

As seen in FIG. 5, the top portion of the tower post A is provided with the winch device 60 for pulling up the bucket D' as the transfer means of freshly mixed concrete which has been introduced into the tower post A, to the upper portion of the tower post A, particularly a position thereof above the discharge port Ab having the chute 105.

The freshly mixed concrete H which has been brought up to the upper portion of the tower post A, particularly above the chute 105 installed to the discharge port Ab in the upper post portion A" by the transfer bucket D' liftably pulled up by the winch device 60, is transferred to the rotary feeder J by the chute 105.

Figure 7:
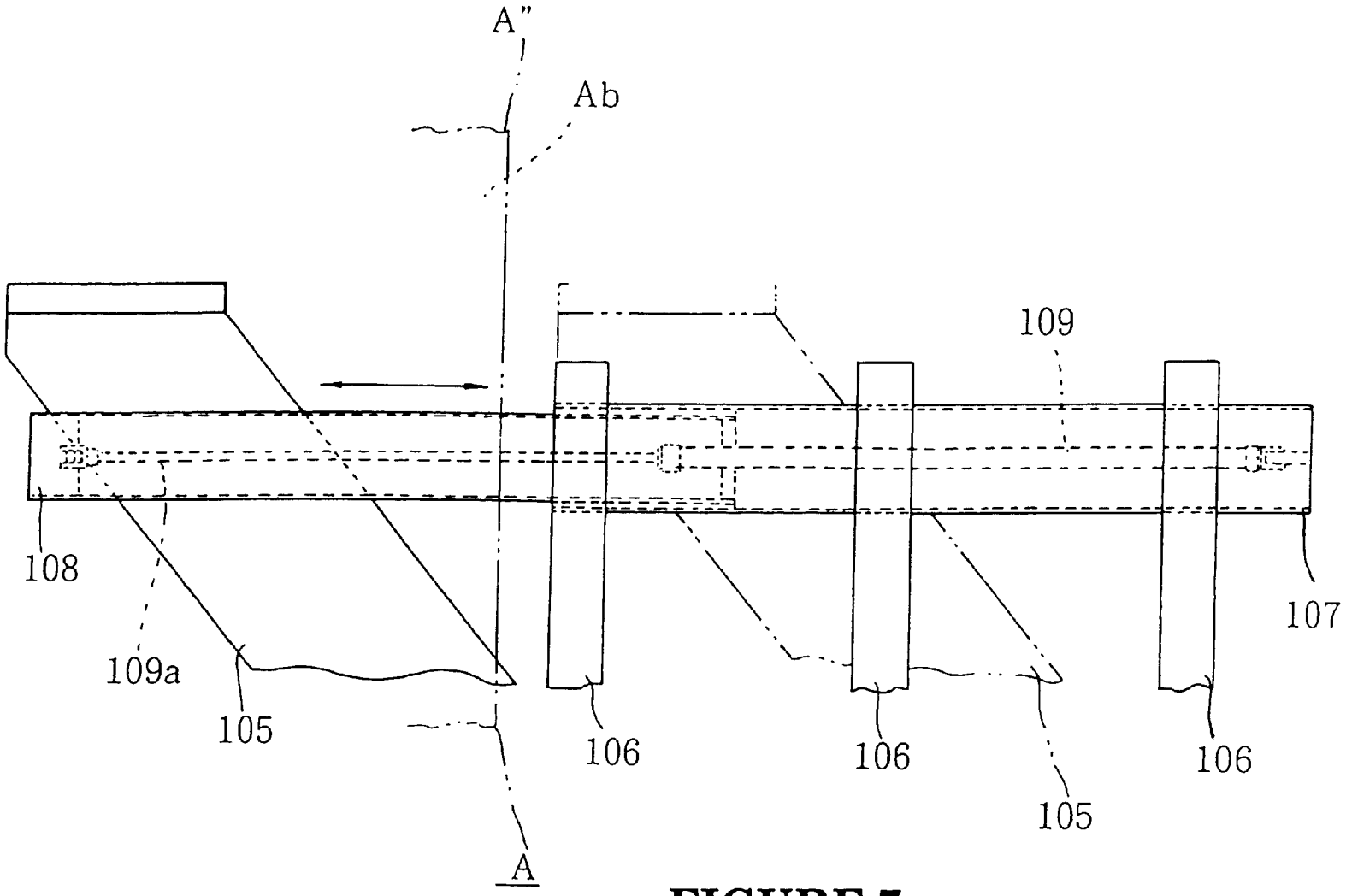
FIG. 7 is a front view showing essential parts of a chute in the device under an operational state.
Figure 8:
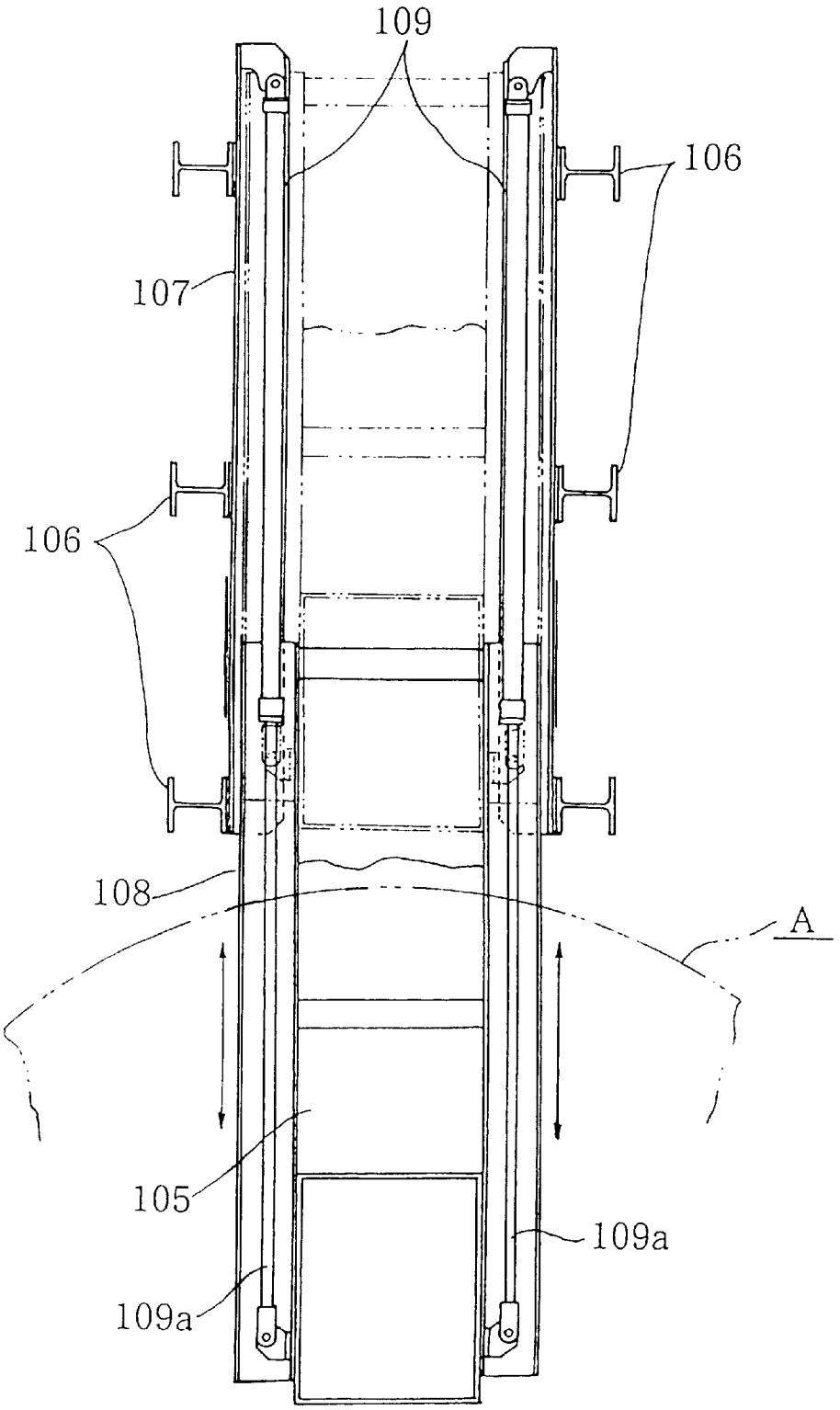
FIG. 8 is a plane sectional view of the essential parts.
Figure 9:
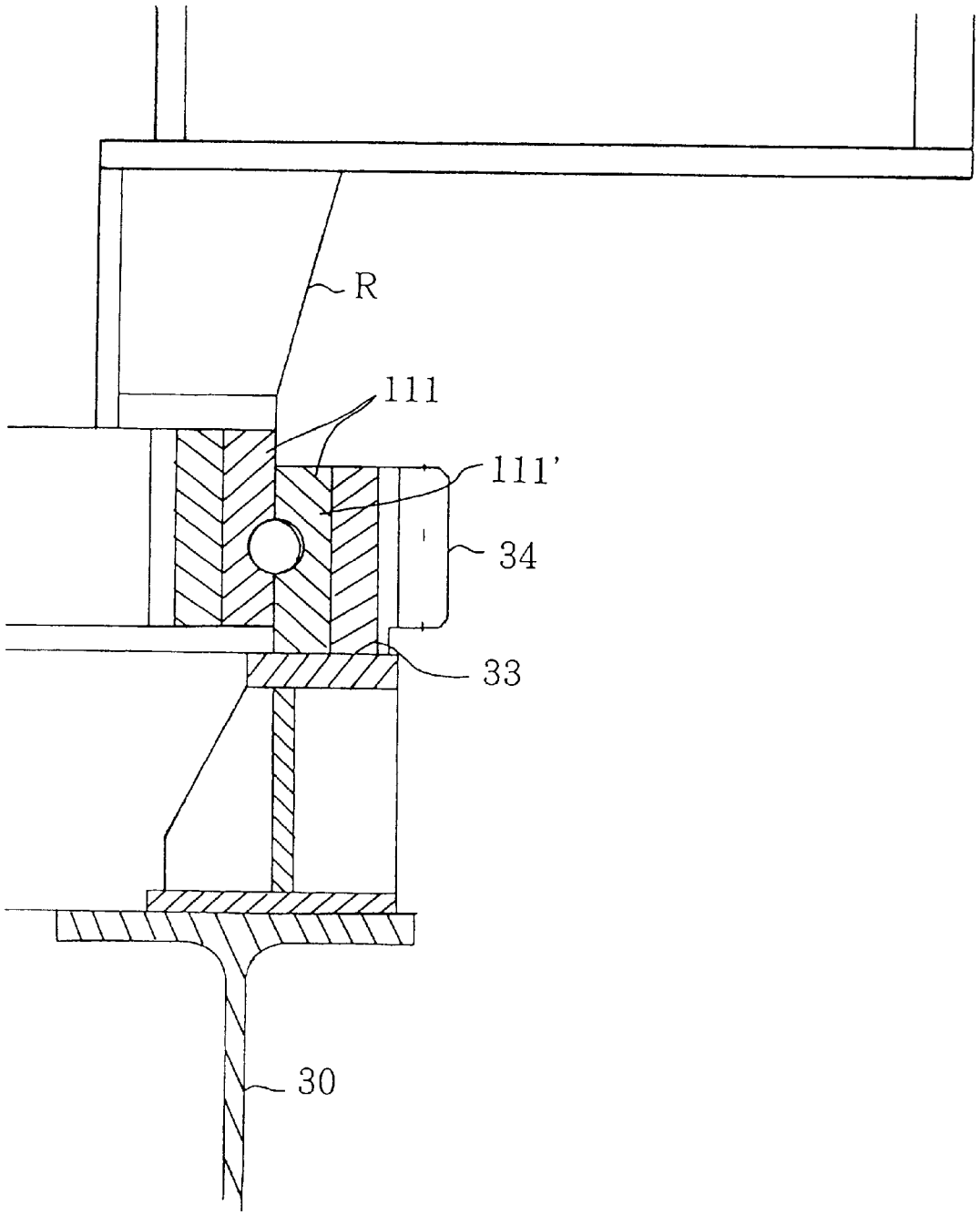
FIG. 9 is a sectional view showing essential portions of a swiveling body in the device.
Figure 10:
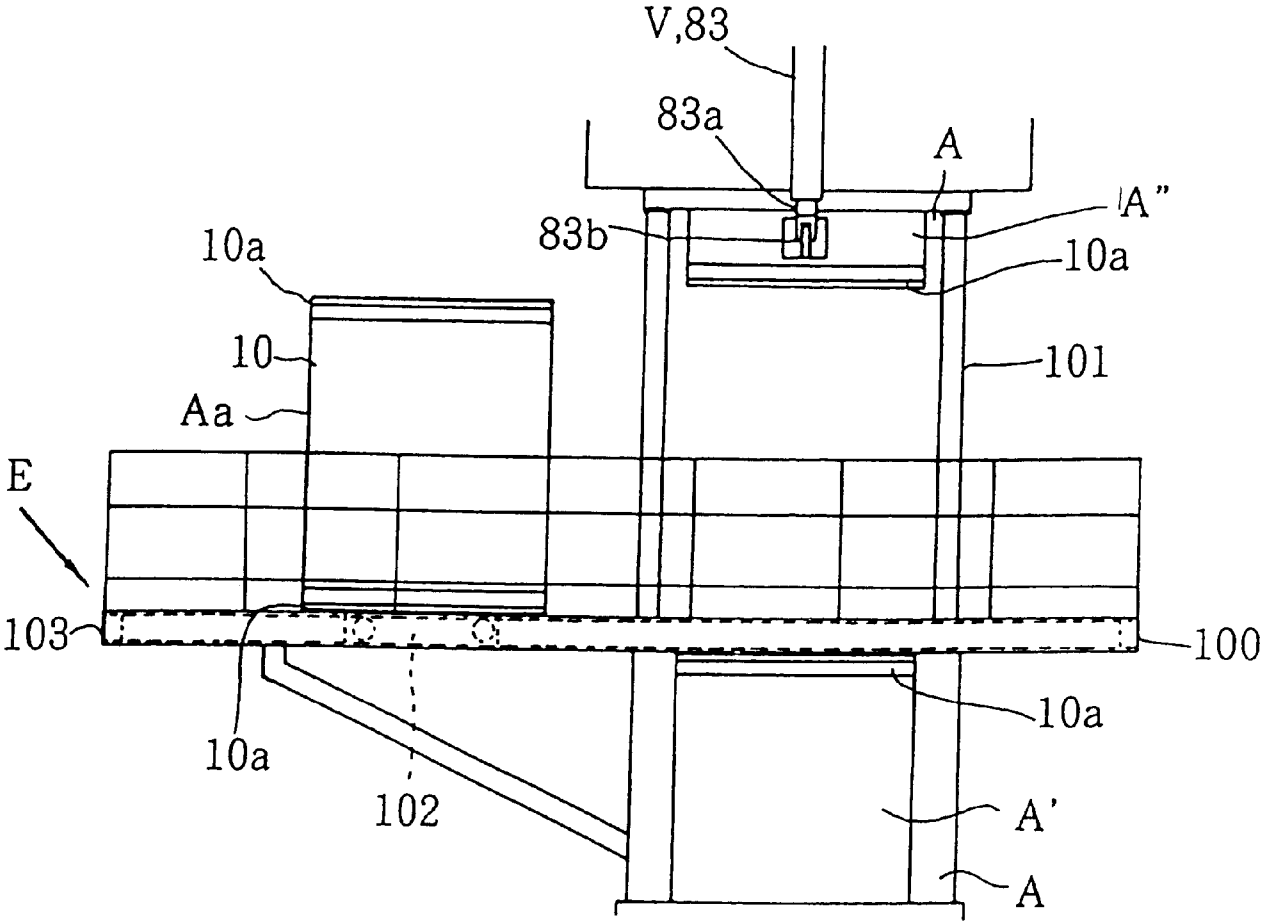
FIG. 10 is a front view showing essential portions of a unit in the device for integrating a post constituent member.
Figure 11:
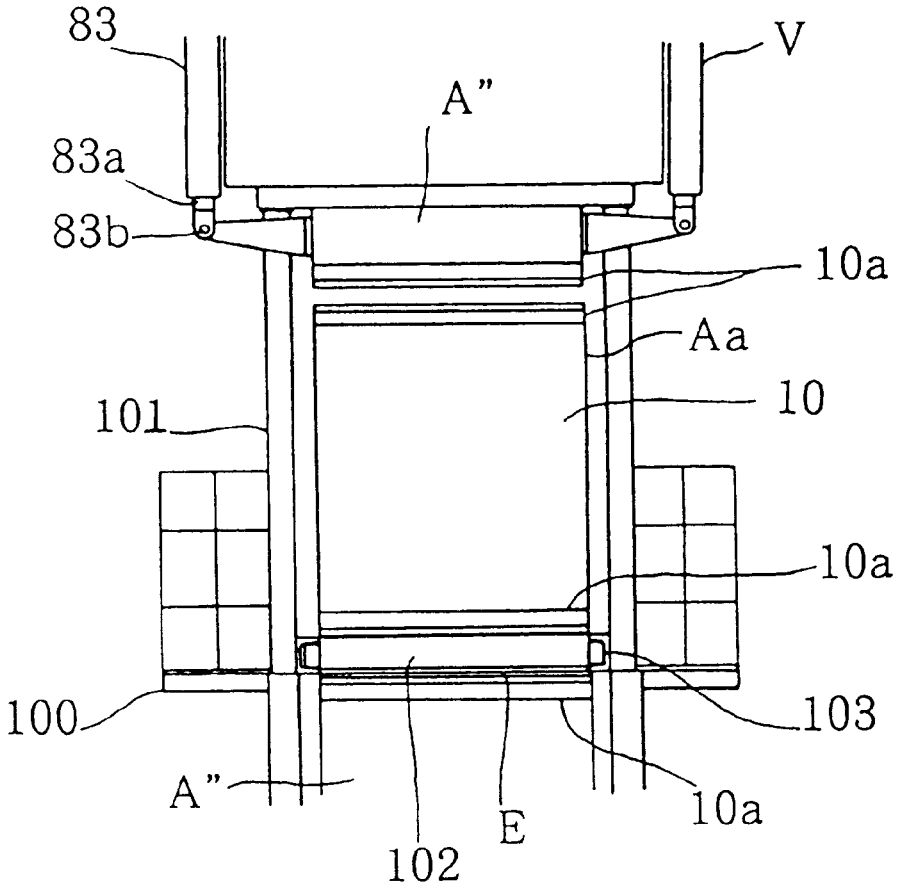
FIG. 11 is a side view showing the essential portions of the integrating unit of the device.
Figure 12A:
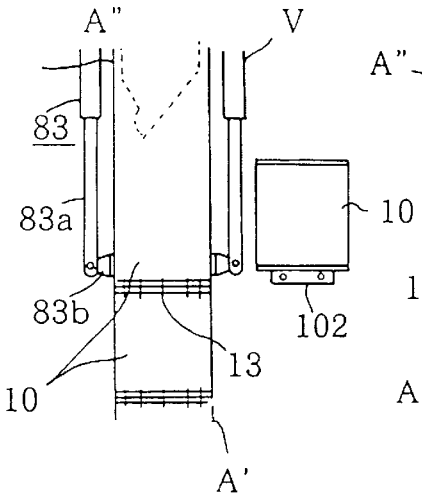
FIGS. 12(A), 12(B), 12(C), 12D), 12(E) and 12(F) are views showing integrating steps of a post constituent member in the device.
Figure 12B:
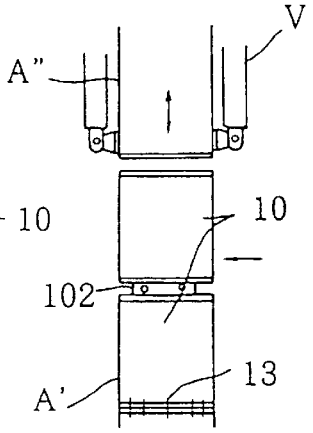
Figure 12C:
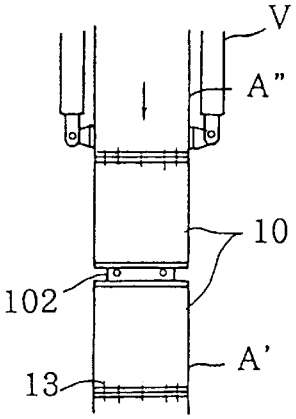
Figure 12D:
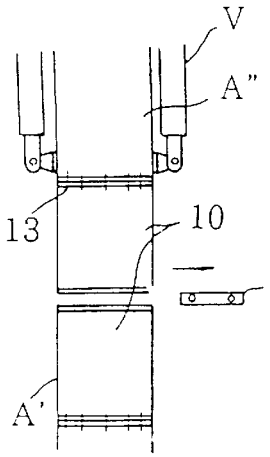
Figure 12E:
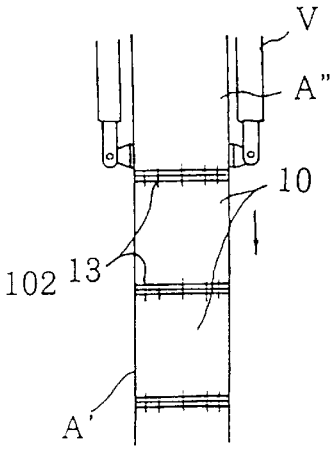
Figure 12F:
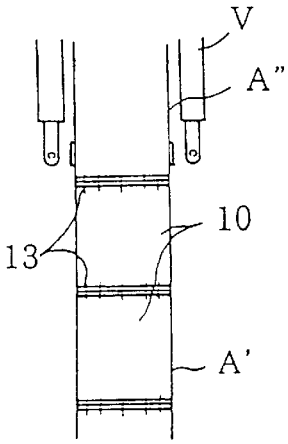

As shown in FIGS. 7 and 8, the chute 105 that is used for discharging the freshly mixed concrete H, is positioned at a location in the tower post A capable of receiving the freshly mixed concrete H from the transfer bucket D' by abrasively moving guide members 108 installed to the chute 105 inside of a pair of guide rails 107 spanning between stays 106 erected on the operation stage 100. Further, the chute 105 can be moved to the outside of the tower post A, that is, to a location where the lifting of the transfer bucket D' in the tower post A is not hampered and the front end of cylinder shafts 109*a* of hydraulic cylinders 109 installed to the guide rails 107, are attached to the guide members 108 of the chute 105.

The freshly mixed concrete H discharged by the chute 105 in this way, is transferred to the rotary feeder J which swivels around the tower post A along with the swiveling body R.

Figure 18:
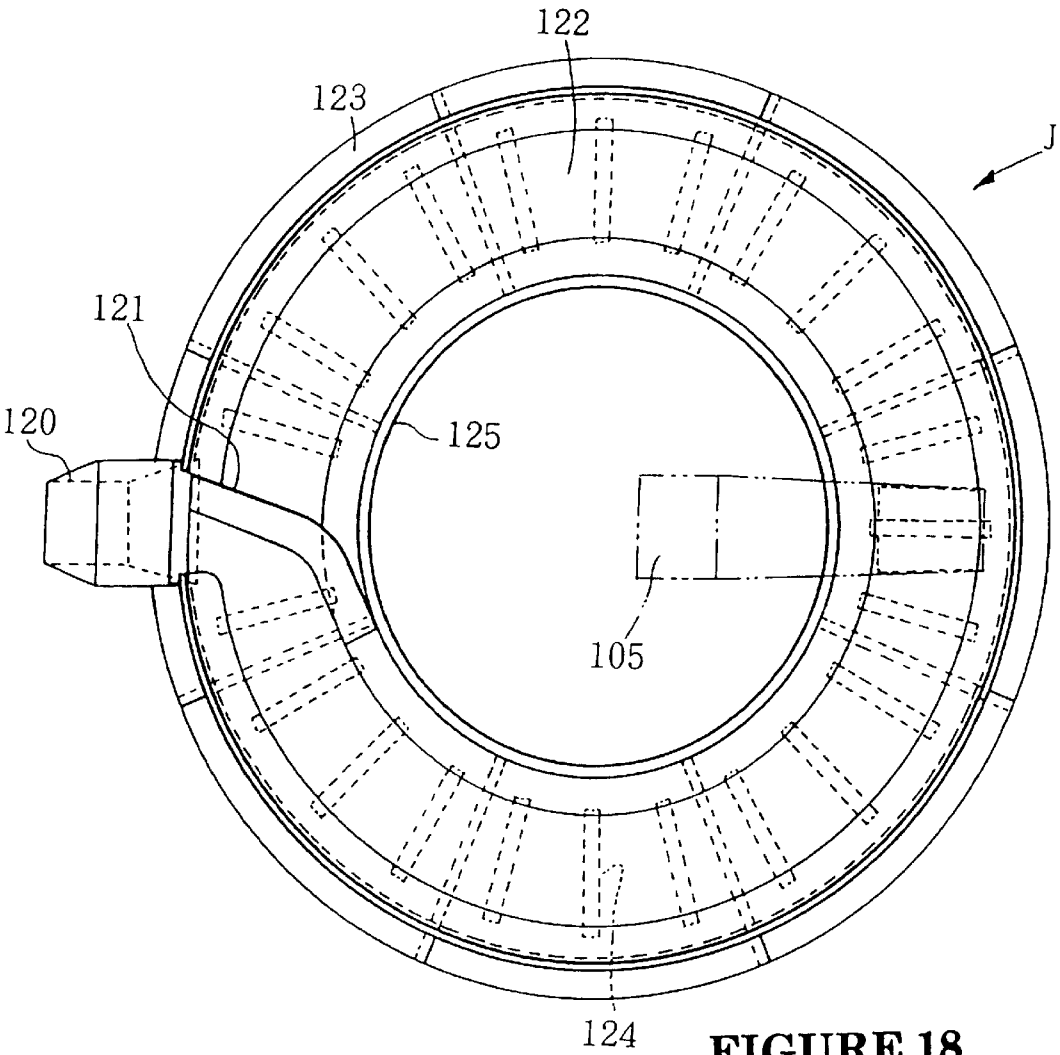
FIG. 18 is a plane view of a rotary feeder in the device.
Figure 19:
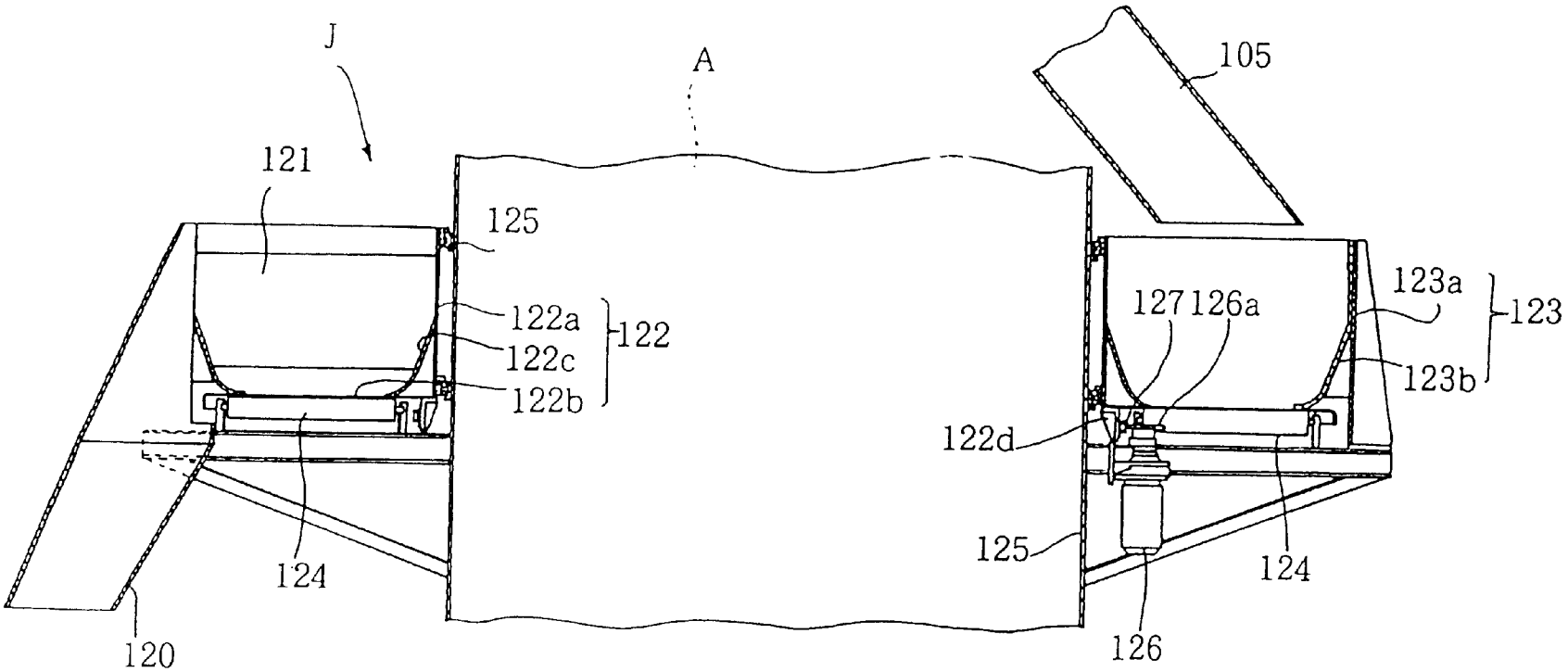
FIG. 19 is a sectional view of the rotary feeder in the device.

As shown in FIGS. 18 and 19, the rotary feeder J receiving the freshly mixed concrete H from the chute 105, a chute 120 for transferring the received freshly mixed concrete H is located at a position forward from a shield plate 121 in respect of the belt conveyor device G installed to the boom F.

The rotary feeder J is provided with an annular groove portion to surround the tower post A, which is constituted by a swiveler 122 and an annular fixed frame 123. Guide rollers 124 are installed below the swiveler 122 in the radial direction of the annular groove portion and the swiveler 122 can be rotated and moved on the guide roller 124.

As shown in detail in FIG. 19, the swiveler 122 constituting the rotary feeder J, comprises a vertical plate portion 122*a* in parallel with the tower post A, a horizontal plate portion 122*b* disposed in the side direction from the lower end of the vertical plate portion 122*a* and moving above the guide rollers 124 and a comer plate portion 122*c* filling the comer portion at the intersection of the respective plate portions 122*a* and 122*b*, and the vertical plate portion 122*a* is rotatably fitted to a guide cylinder portion 125 surrounding the tower post A.

Further, the swiveler 122 is made rotatable by bringing a gear 126*a* of a drive motor 126 installed on the side of the guide cylinder portion 125 in mesh with a chain with attachment 127 installed under tension to the outer periphery of an annular plate portion 122*d* that is attached to the swiveler 122.

The fixed frame 123 constituting the groove portion for guiding the freshly mixed concrete H along with the swiveler 122, is provided with a vertical plate portion 123*a* opposed to the vertical plate portion 122*a* of the swiveler 122 and a rubber plate portion 123*b* for preventing the freshly mixed concrete H transferred on the horizontal plate portion 122*b* from leaking, by getting in contact with the face of the horizontal plate portion 122*b* of the swiveler 122 from a middle portion of the vertical plate portion 123*a*.

Figure 14:
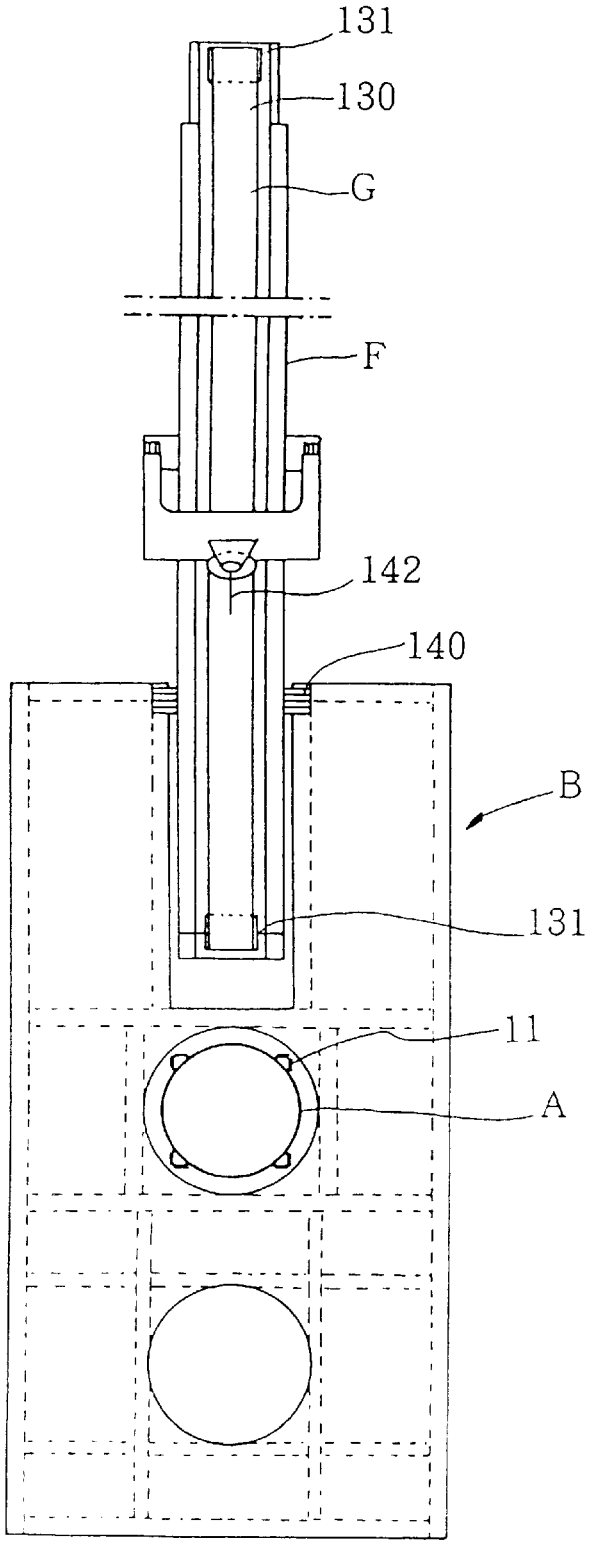
FIG. 14 is a plane sectional view showing the swiveling body in the device.
Figure 15:
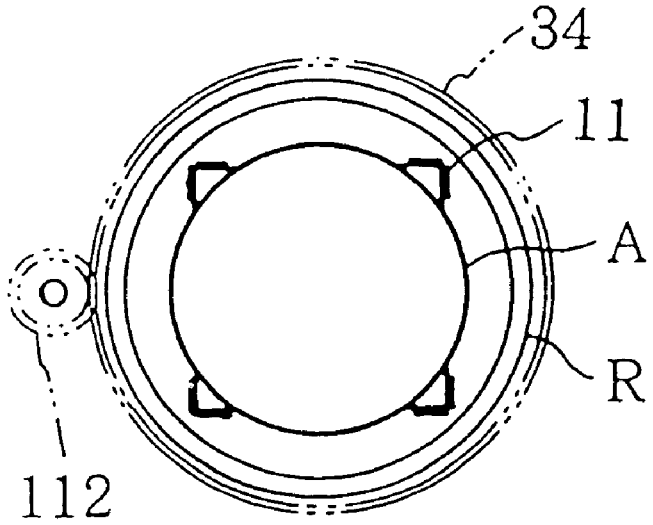
FIG. 15 is a view showing the swiveling body in the device.
Figure 16:
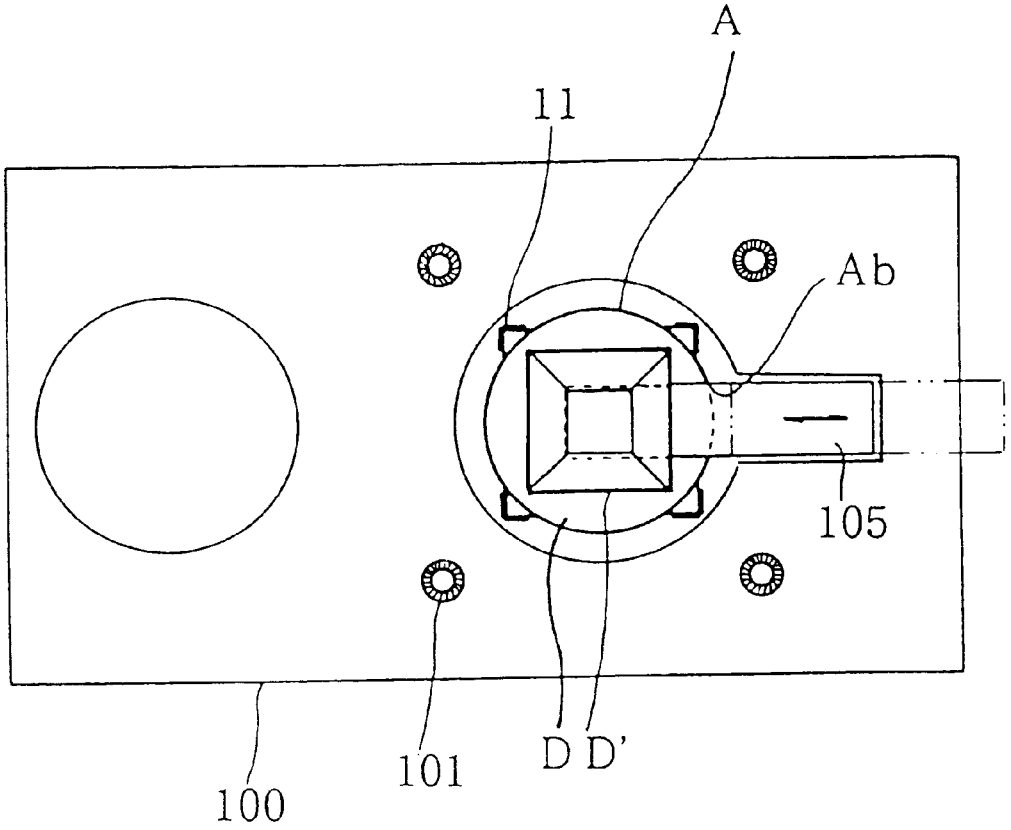
FIG. 16 is a plane sectional view showing an operation stage in the device.
Figure 17:
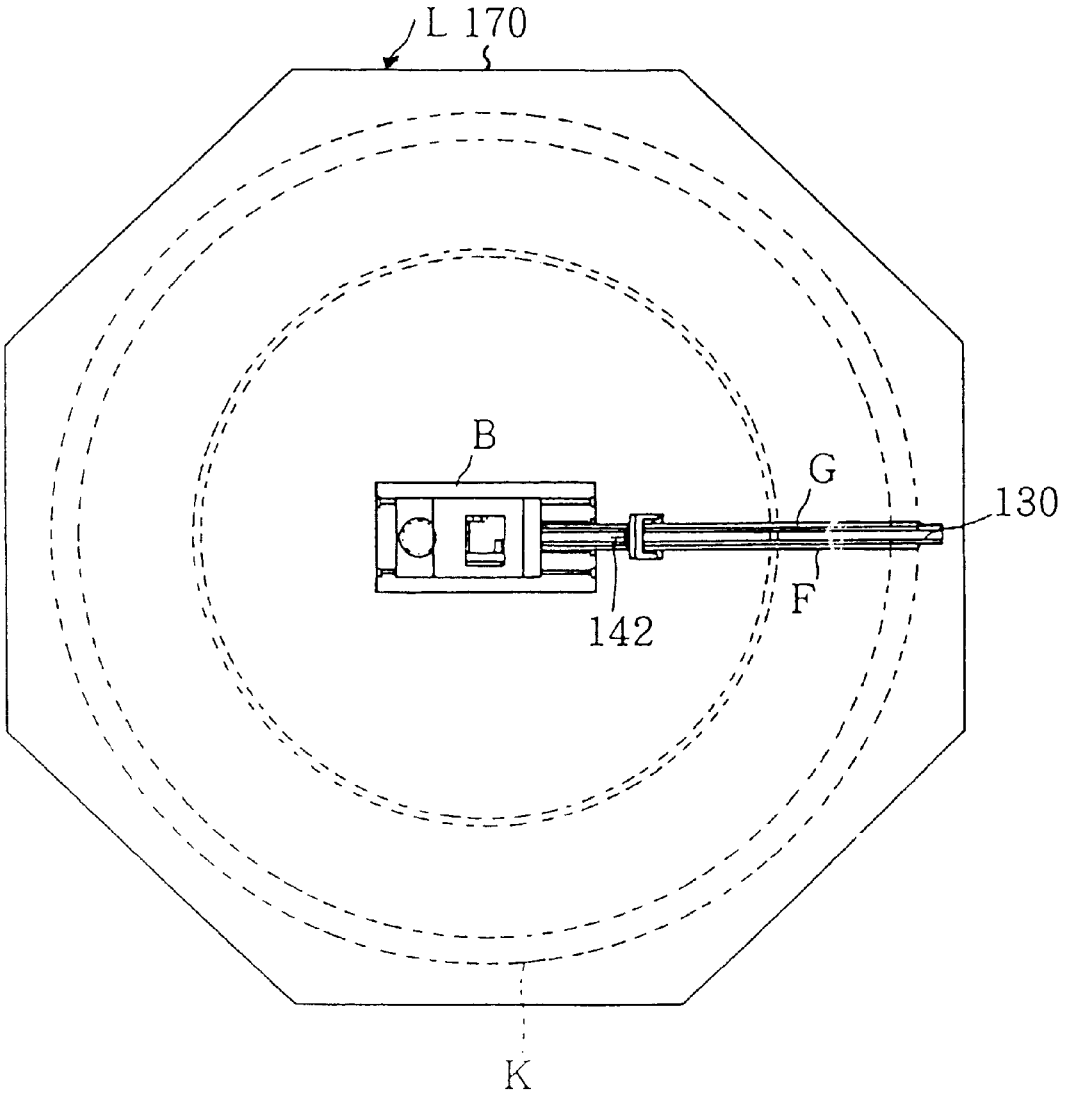
FIG. 17 is a plane view of the device.

Referring also to FIGS. 14 and 17, the belt conveyor device G for receiving the freshly mixed concrete H from the rotary feeder J, is installed onto the boom F provided to the swiveling body R and is constituted by a conveyor belt 130 spanning between respective rollers 131 installed to the side of an attaching base of the boom F and a front end side thereof, which is driven by using a motor 132.

As shown in FIGS. 2 and 3, the belt conveyor device G installed to the boom F, may be provided with a tripper device 133 movably in respect of the boom F. In this case the driven conveyor belt 130 is bent in a S-like shape at an arbitrary position of the boom F and the freshly mixed concrete H is discharged from the end of the bent portion toward a chute 133*a*.

Incidentally, the boom F installed to the swiveling body R is erectably provided to the swiveling body R around a pivoting shaft 140 and is held by a wire 142 of a winch 141, as shown in FIG. 3.

Further, the boom F installed to the swiveling body R may be constituted by a boom on the side of the base portion and a single or a plurality of booms which can be extracted forwardly from the boom on the side of the base portion.

Incidentally, a motor-driven hoist 150 that is used for hanging or moving various machines for mold frame materials and the like, is movably installed to the boom F constituted as described above.

An explanation will be given of a specific example of constituting a concrete structure, particularly of an example of constructing the cylindrical structure K by using the tower-like transfer device constituted as described above.

In constructing a concrete structure by using transferred freshly mixed concrete, the second lift L is separately prepared below the first lift B in the tower post A and the cylindrical structure K is constructed as a concrete structure by using the second lift L.

Figure 1:
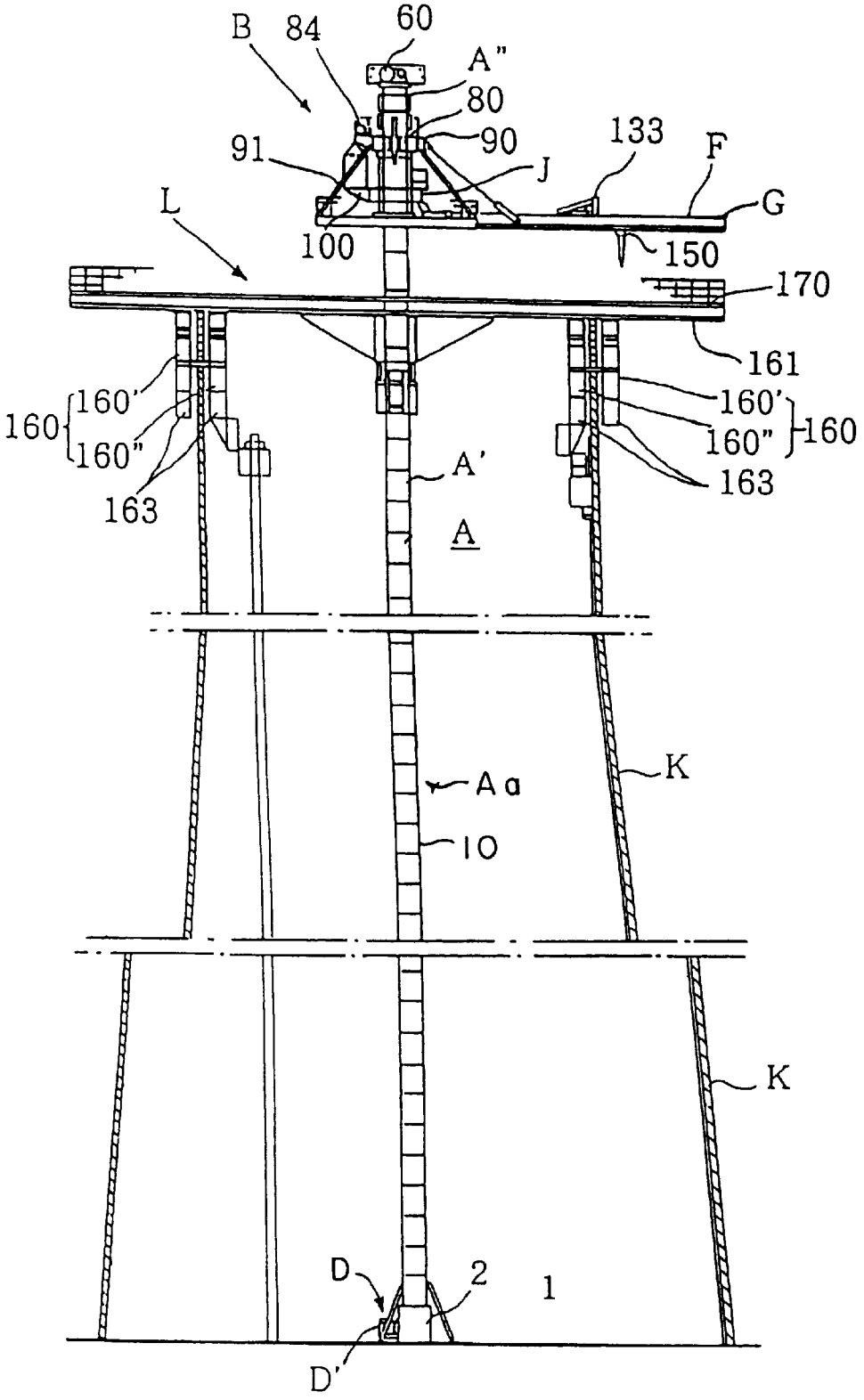
FIG. 1 is a partially broken front view showing a tower-like transfer device in accordance with a typical embodiment of the present invention.

As shown in FIG. 1, a concrete mold frame 160 that is used in constructing the cylindrical structure K such as a concrete chimney, a concrete silo or the like, is prepared to attach to the second lift L that is liftably installed to the tower post A and the installed mold frame 160 is constituted to adapt to the mode of the constructed cylindrical structure K.

Here, the second lift L installed with the mold frame 160, is constituted by the operation stage 170 integrated to the tower post A movably in the up and down direction and lifting means for the operation stage 170, and is liftably integrated to the tower post A similar to the first lift B.

Figure 20:
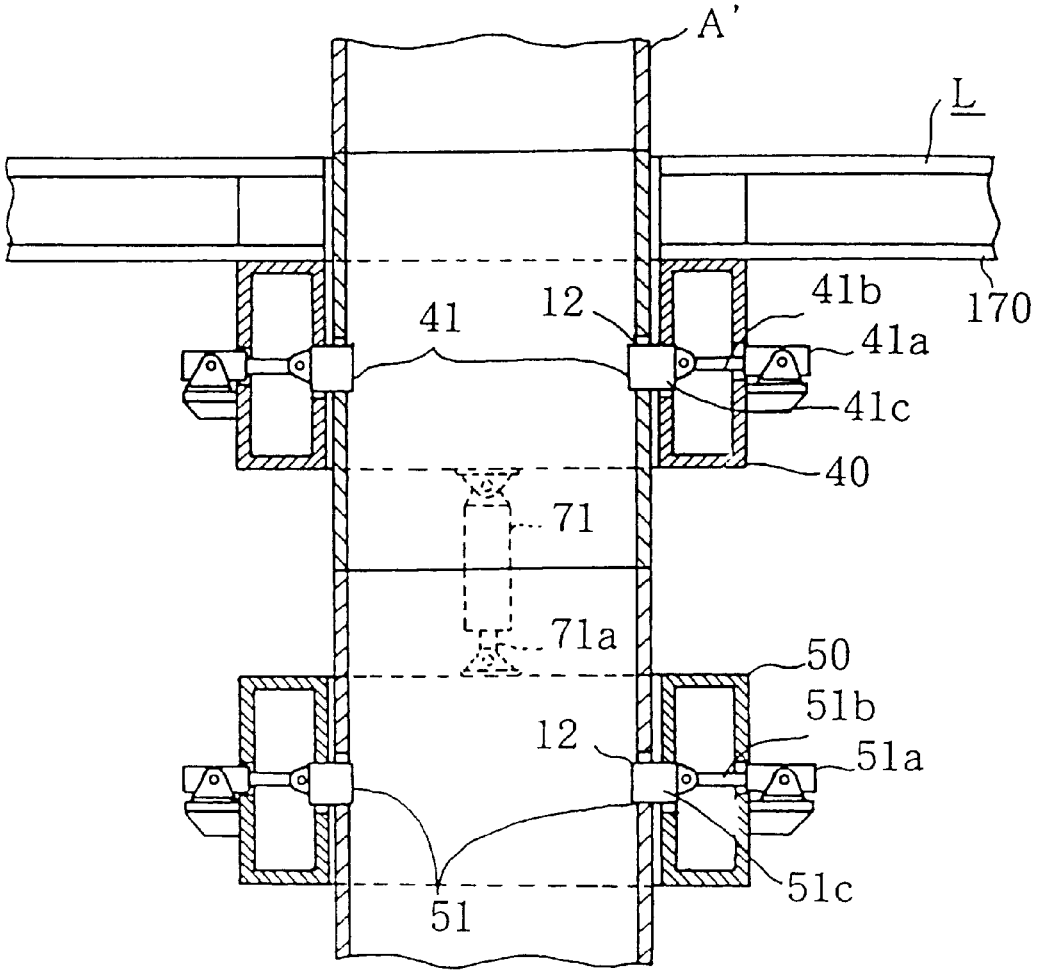
FIG. 20 is a sectional view showing essential portions of a second lift in the device.

The lifting means of the second lift L is constituted by a pair of an upper lift frame 40 and a lower lift frame 50 and the upper lift frame 40 and the lower lift frame 50 are connected by hydraulic cylinder devices 71. Further, the respective lift frames 40 and 50 are provided with guide rolls 42 and 52 guided by the guide rails 11 installed to the outer peripheral face of the tower post A similar to those of the upper lift frame 20 and the lower lift frame 30, and locking means 41 and 51 for locking the respective lift frames 40 and 50 to the tower post A. Respective lock sticks 41*a* and 51*a* of the respective locking means 41 and 51 can be inserted into the respective lock holes 12 at the tower post A in an insertable and drawable fashion, as shown in FIG. 20.

The second lift L having such a constitution can be moved by a process the same as that of the first lift B. That is, the locking of the upper lift frame 40 to the tower post A is released, in which cylinder shafts 41*b* of hydraulic cylinders 41*a* installed as the locking means 41, are retracted whereby lock sticks 41*c* are drawn from the lock holes 12 of the tower post A. Under this state cylinder shafts 71*a* of the hydraulic cylinder devices 71 are extracted whereby the upper lift frame 40 is moved upwardly along with the operation stage 170 and the upper lift frame 40 which has been moved upwardly, is fixed to the tower post A by the locking means 41.

Next, lock sticks 51*c* of the locking means 51 in the lower lift frame 50 are drawn from the lock holes 12 of the tower post A by retracting cylinder shafts 51*b* of hydraulic cylinders 51*a* and the lower lift frame 50 is pulled up upwardly by retracting the cylinder shafts 71*a* of the hydraulic cylinder devices 71.

The lower lift frame 50 which has been pulled up, is locked to the tower post A by inserting the lock sticks 51*c* into the lock holes 12 by extracting the cylinder shafts 51*b* of the hydraulic cylinders 51*a* in the locking means 51 installed to the lower lift frame 50.

The operation stage 170 installed to the second lift L used here, is integrated to the upper lift frame 40 that is constituted as a climbing means, and is constructed as a disc-like stage body.

Figure 22:
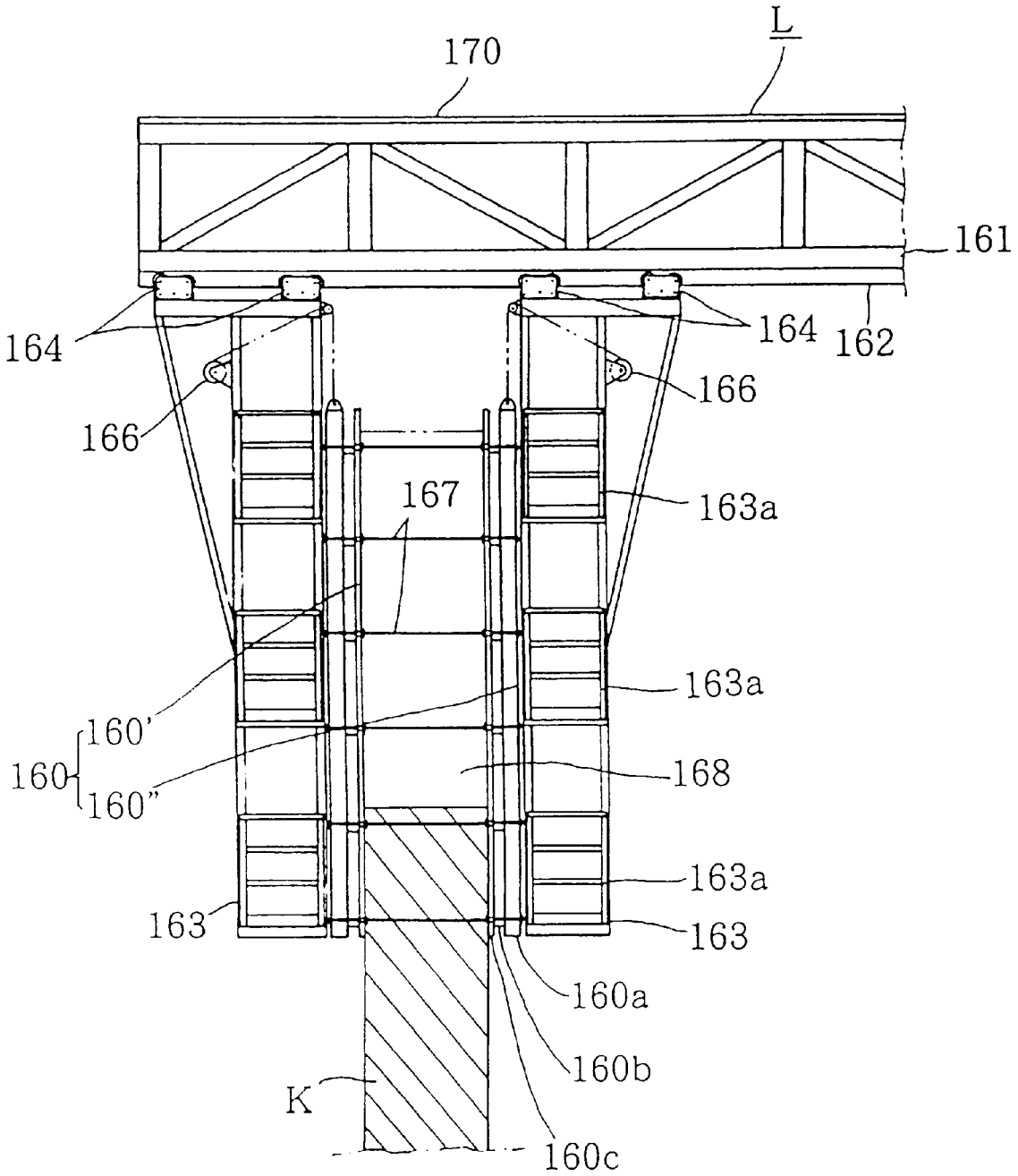
FIG. 22 is a sectional view of a mold frame integrating unit in the device in view from the side direction.

As shown in FIG. 22, guide rails 162 are installed at the lower face of a base frame 161 in the radial direction from the center side and operation scaffold frames 163 for the mold frame 160 are movably installed to the respective guide rails 162.

Figure 27:
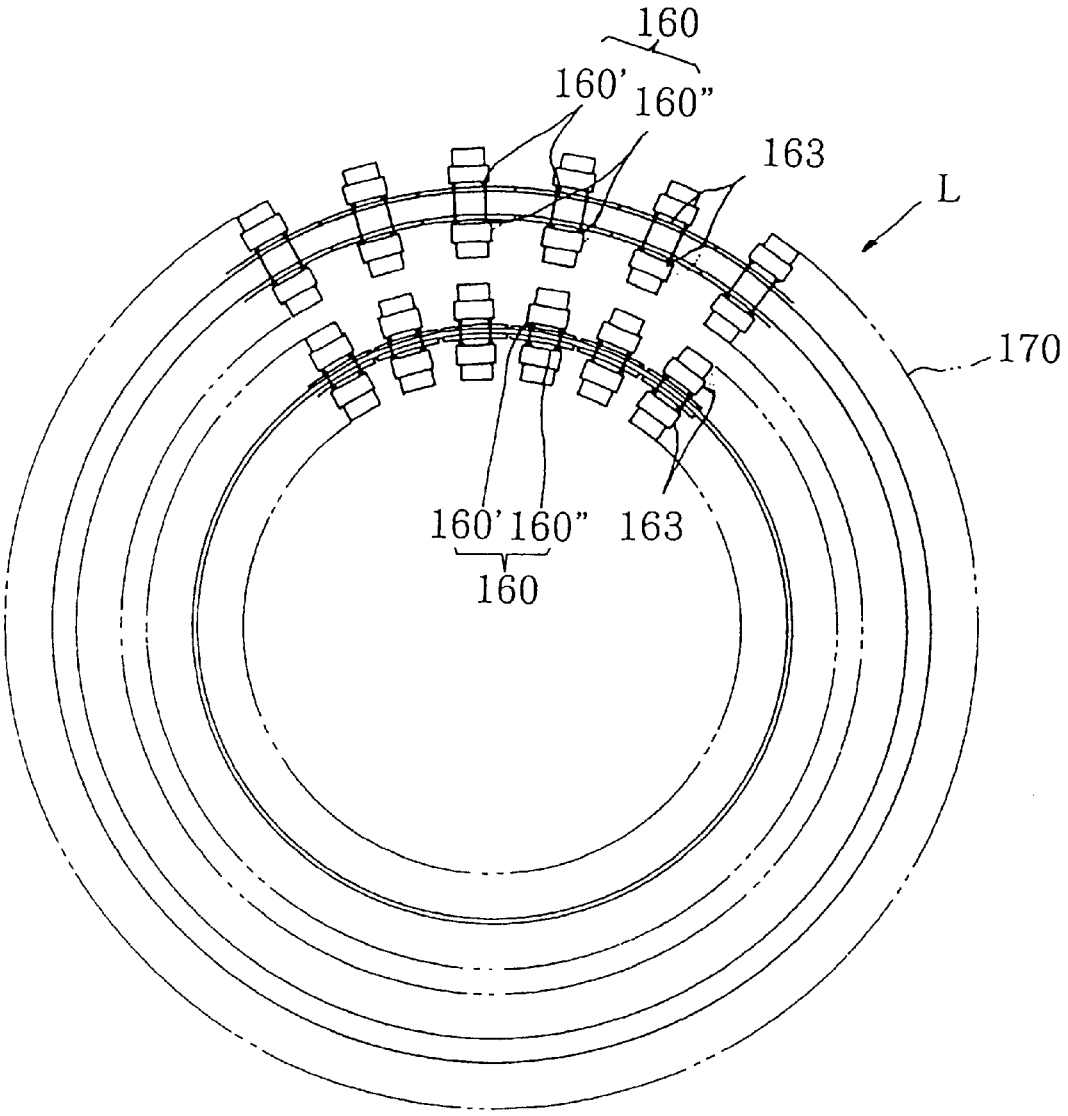
FIG. 27 is a constitutional view showing the mold frame integrating unit in the device in view from the bottom direction.

Incidentally, the respective mold frames 160 attached to the guide rails 162 can be moved on a line extending in the radial direction from the side of the tower post A by installing the guide rails 162 on the operation stage 170 in the radial direction from the side of the tower post A. (FIG. 27 illustrates the integrated states of the respective ones of the mold frame 160 before moving them along the guide rails 162 and after moving them.)

Pairs of the scaffold frames 163 hang from the guide rails 162 at both sides of the upper end portion of the constructed cylindrical structure K, or at positions pinching the upper end portion of the constructed cylindrical structure K from the outer side and the inner side in the illustrated example, and are provided with pairs of outer mold frames 160' and inner mold frames 160" on opposed faces of the respective scaffold frames 163.

Each of the scaffold frames 163 according to this embodiment, each is provided with three stages of scaffolds 163*a* in the vertical direction of the frame and are integrated to the parallel pair of guide rails 162 via respective guide roll devices 164 which are installed on both sides of the scaffold frames 163.

Further, according to the respective guide roll devices 164, pairs of the guide roll devices 164 are installed in the operational direction of the scaffold frame 163, that is, at respective forward and rearward positions of the pairs of guide rail 162. Each of the guide roll devices 164 hang from at least four locations or more of the guide rails 162 below the base frame 161.

Each of the scaffold frames 163 is provided with drive motors 165, which is suitable for integrating and removing the mold frame 160.

Figure 23:
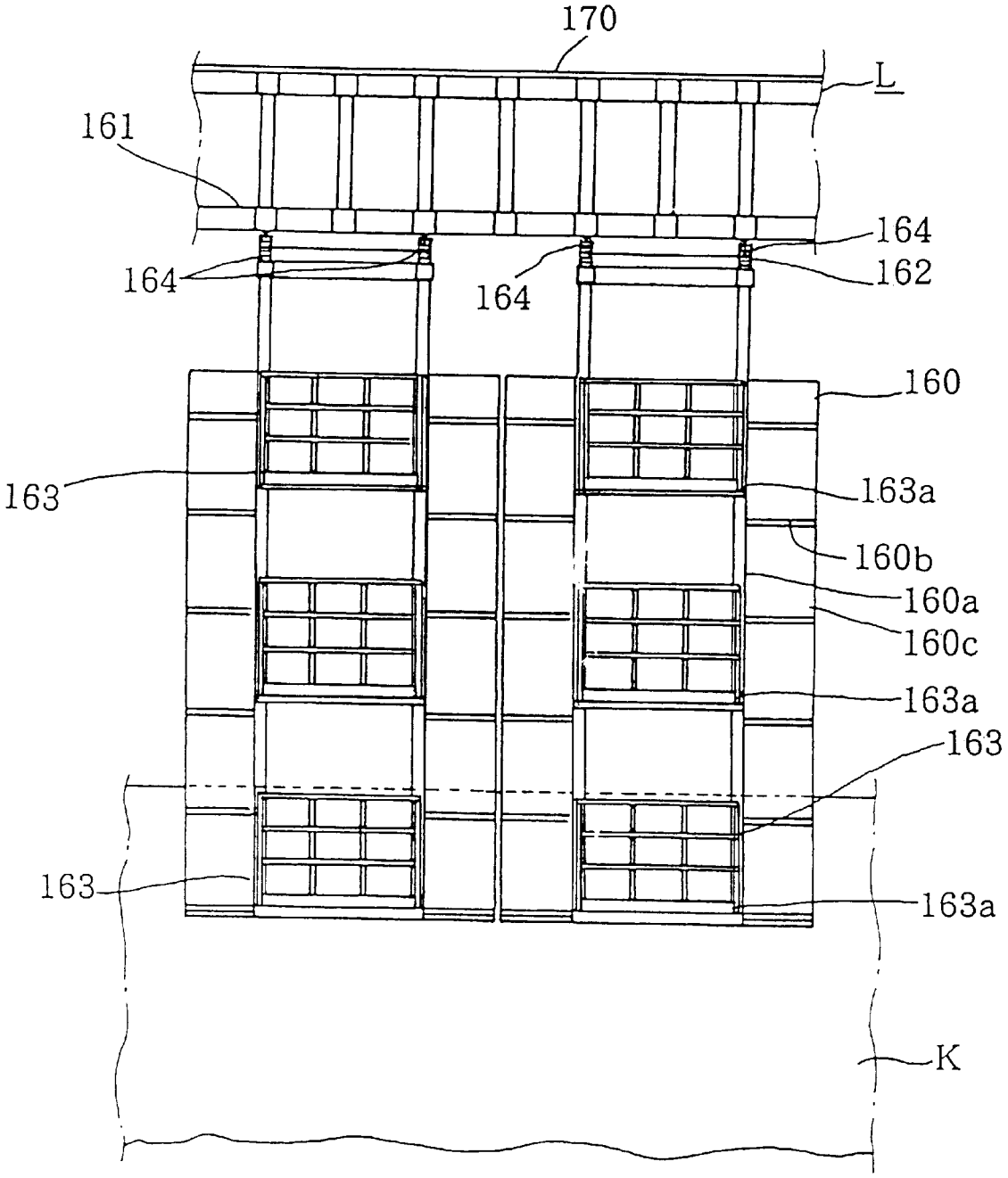
FIG. 23 is a front view of the mold frame integrating unit in the device.

As shown in FIG. 23, the mold frame 160 integrated by using the respective scaffold frames 163, is provided with mold plates 160*c* installed to frames reinforced by vertical members 160*a* and horizontal members 160*b*, and can be installed liftably to respective opposed faces of the scaffold frames 163 by manual winches 166.

The mold frames 160*c* used here in constructing the cylindrical structure K, are prepared to have a curved or bent mold plate face such that the respective mold plates 160*c* of the formed mold frame 160 in series, constitute a continuous annular body.

Figure 24:
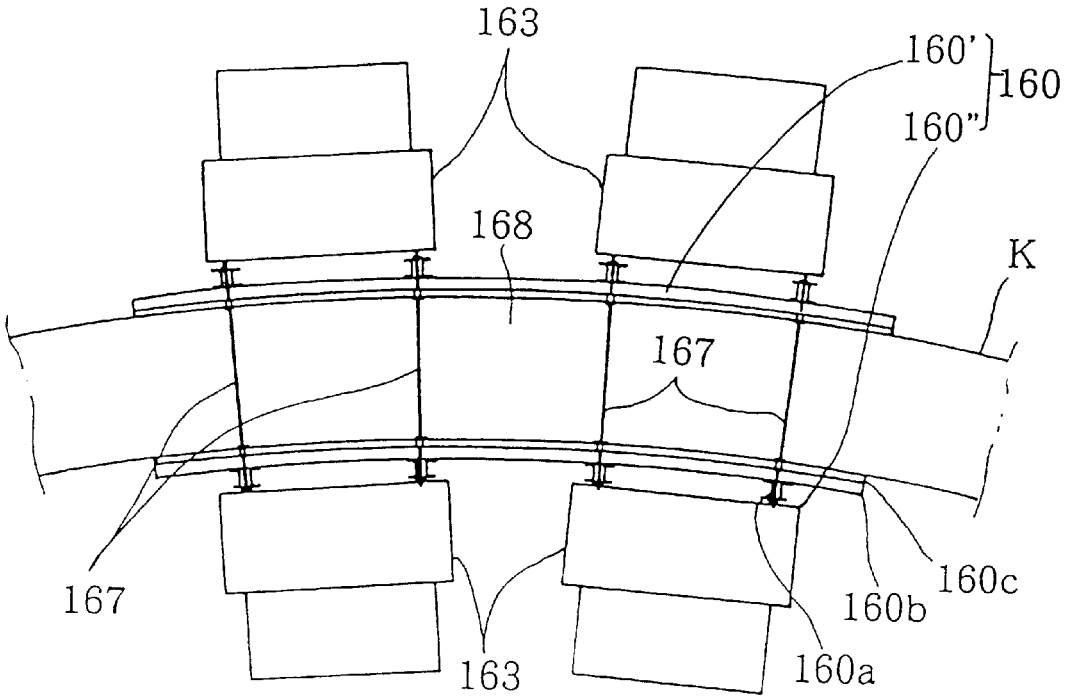
FIG. 24 is a plane sectional view of the mold frame integrating unit in the device.
Figure 25:
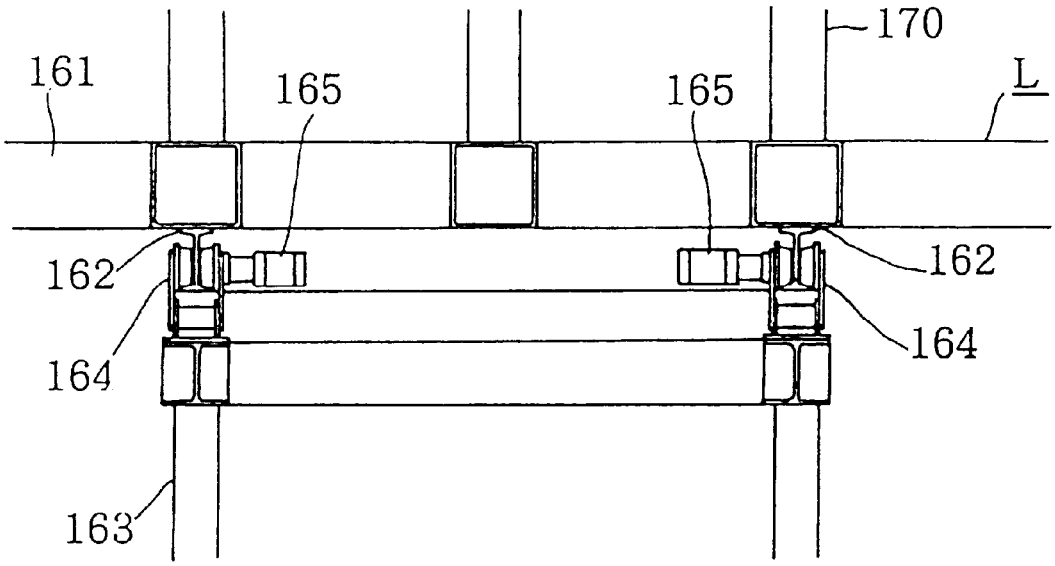
FIG. 25 is a sectional view showing essential portions of the mold frame integrating unit in the device in view from the front direction.
Figure 26:
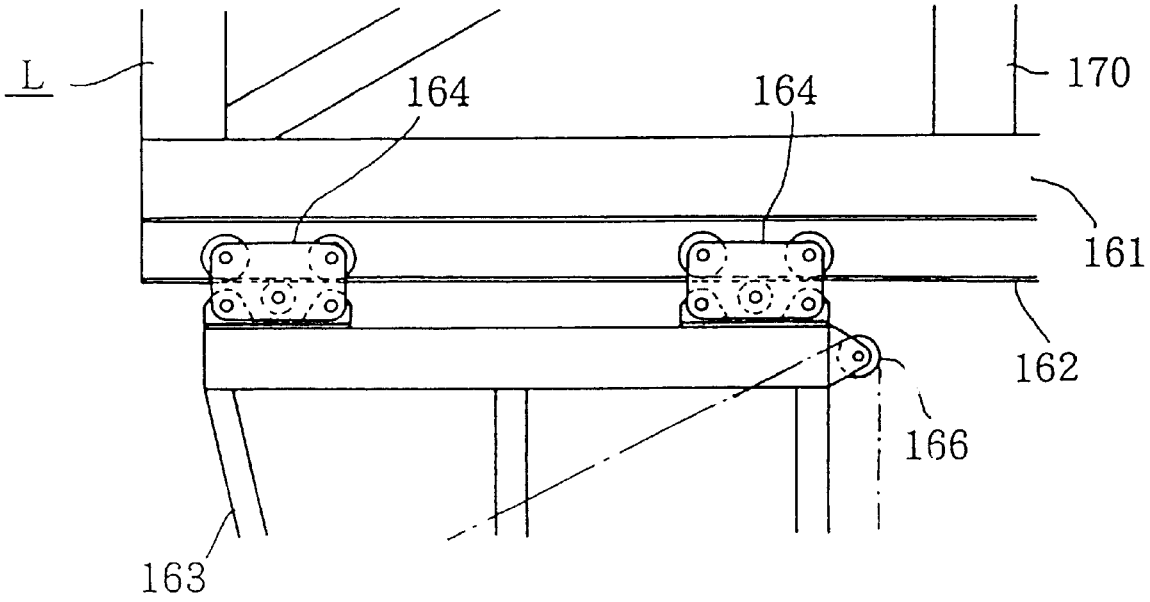
FIG. 26 is a side view of essential portions of the mold frame integrating unit in the device.

Referring also to FIGS. 24 and 25, the respective scaffold frames 163 installed to the respective guide rails 162 below the base frame 161 constituting the operation stage 170 in the second lift L, are set to predetermined locations by moving them by the respective drive motors 165. The lower end portions of the mold plates 160*c* of the respective portions of the mold frame 160 are brought into close contact with the inner side face and the outer side face of the upper end portion of the cylindrical structure K and the respectives of the outer mold frame 160' and the inner mold frame 160" are connected by separators 167.

The formation of the respective portions of the mold frame 160 is executed at each of the scaffold frames 163 thereby constituting a recessed portion for feeding concrete as a mold frame space 168 for feeding concrete in an annular groove shape below the circular base frame 161 constituting the operation stage 170 in the second lift L.

In use, the installation of reinforcement which may be necessary for constructing the cylindrical structure K is previously executed, executed along with the mold frame formation, or executed after the mold frame formation.

The freshly mixed concrete H is fed to the gap for feeding concrete formed between the outer mold frame 160' and the inner mold frame 160" which have been constructed as described above by the belt conveyor device G installed to the boom F.

In feeding the freshly mixed concrete H from the belt conveyor device G on the boom F, the chute 169 as shown in FIGS. 1 and 2, is installed at the front end of the belt conveyor device G or in respect of the tripper device 133 installed to the belt conveyor device G and the freshly mixed concrete H is fed to the space 168 constituted by the outer mold frame 160' and the inner mold frame 160" by using the chute 169.

The typical transfer path of the freshly mixed concrete H is will now be described.

Firstly, the freshly mixed concrete H supplied by a concrete mixer truck, a transfer car, a belt conveyor or the like (not shown), is charged to a transfer bucket D' provided in the tower post A.

As shown in FIG. 21, in charging the freshly mixed concrete H to the transfer bucket D' , for example, the carrier 16 mounted with the transfer bucket D' is moved to the position of supplying the freshly mixed concrete H along the rails 15 laid on the installing face of the tower post A, the freshly mixed concrete H is received by the transfer bucket D' on the carrier 16 from a concrete mixer truck or the like and the carrier 16 is moved into the tower post A.

As shown in FIGS. 4 and 5, the transfer bucket D' on the carrier 16 is pulled up to above the chute 105 of the discharge port Ab installed to the upper post portion A" by the winch device 60 installed to the top portion of the tower post A.

The chute 105 is moved from the outside of the tower post A to below the transfer bucket D' which has been pulled up by the winch device 60 and the freshly mixed concrete H in the transfer bucket D' is transferred to the chute 105.

The freshly mixed concrete H fed from the chute 105 is guided from the chute 105 to the rotary feeder J and is fed from the chute 120 of the rotary feeder J onto the conveyor belt 130 of the belt conveyor device G installed to the boom F. The concrete H is then transferred from the front end portion of the conveyor belt 130, or the tripper device 133 to the mold frame space 168 by using the chute 169.

After a predetermined curing procedure, the scaffold frames 163 are moved and the mold removing procedure is executed, the second lift L is elevated to a height necessary for constructing a successive mold frame and the mold frame formation is executed by the respective procedures described above whereby continuous feeding of concrete can be executed successively with respect to the top portion of the cylindrical structure K.

Additionally, in forming the above-described mold frame 160, concrete tower bodies having various shapes, for example, a cylindrical tower body which gradually becomes slender toward the upper direction, or a cylindrical tower body where the top side becomes thick again, and the like, can be constructed by moving the respective portions of the mold frame 160 along the guide rails 162 and preparing the mold frame 160 having the mold plates 160*c* provided with different dimensions and shapes.

Next, an explanation will be given of a typical example of constructing the device constituted as described above and an example of handling thereof.

First, the post constituent members are integrated to constitute a required height at a substantially central portion of the foundation 1 of the cylindrical structure K in a state where the upper post portion A" is installed and the openings 14 and the like are provided whereby the tower post A is constructed.

Further, the post constituent members Aa for continuous erection are integrated to the post constituent member below the upper post portion A" as necessary and the first lift B and the second lift L are integrated to the tower post A.

Next, the respective portions of the mold frame 160 are installed to the base frame 161 of the second lift L and the formation of the respectives of the frame 160 is executed with a reference of the foundation of the cylindrical structure K which has been constructed and prepared, or an erected portion constructed on the foundation.

Meanwhile, the swiveling body R in the first lift B is swiveled and the chute 133*a* of the tripper device 133 in the belt conveyor device G is operated to position above the mold frame space 168 to which concrete is to be fed and the freshly mixed concrete H is successively fed to the mold frame space 168 for feeding concrete that is constituted in an annular shape while swiveling the swiveling body R.

After feeding the freshly mixed concrete H and curing the fed concrete H, the mold frame 160 is removed and the second lift L is moved upwardly along the tower post A while carrying the mold frame 160 by the above-described procedure.

Meanwhile, the post constituent member Aa for continuous erection is connected onto the lower tower post A' by the above-described procedure and the first lift B is moved upwardly along the tower post A.

The annular structure K is constructed to a predetermined height by feeding the freshly mixed concrete H to the mold frame space 168 by repeating the respective operation.

Further, in the case where the cylindrical structure K is not in a cylindrical shape or a shape of a square cylinder, the respective portions of the frame 160 are moved along the guide rails 162 and at the moved positions, the mold formation is executed by changing the mold frame to those having different shapes and dimensions which can constitute the mold frame space 168 for feeding concrete in an arbitrary ring shape whereby the mold frame formation is executed in compliance with construction of cylindrical structures K having various shapes and opening sizes.

Further, the position of installing the tipper device 133 installed to the belt conveyor device G is moved in correspondence with the change in the mold frame formation and in this way the freshly mixed concrete H is fed to the mold frame space 168 for feeding concrete.

As a result, for example, the cylindrical structure K of which size of opening is gradually changed, which is illustrated in FIG. 1, can be constructed other than a structure having a straight cylindrical shape.

Further, a cylindrical structure K with the sectional shape having complicated bent faces other than circular shape or square shape can be constructed.

After constructing the cylindrical structure K in this way, the second lift L is disintegrated and the boom F is erected by using the winch 141.

Successively, the post constituent members Aa for continuous erection at the upper end portion of the lower post portion A' are removed and the first lift B are lowered, whereby the first lift B is lowered to the ground level and disintegrated whereby the device can be removed.

The tower-like transfer device in accordance with the present invention is constituted by the cylindrical tower post A having the upper post portion A" and the lower post portion A' that is constructed by connecting the post constituent members of one kind or two kinds or more, the lift B liftably provided to the tower post A, the upper post portion lifting means V for lifting the upper post portion A" in integrating the post constituent member between the upper post portion A" disconnected from the lower post portion A' and the lower post portion A', and for holding the upper post portion A" disconnected from the lower post portion in removing the post constituent member at the top end of the lower post portion A' from the lower post portion A', and the transfer means D liftably installed to the tower post A. Therefore, the tower post A can be extended upwardly irrespective of the mold of the upper post portion A", particularly, without shifting various transfer means such as a winch etc. provided to the upper post portion A" or relocating them, or the tower post A in a state where the various facilities etc. are provided to the upper post portion A", can successively be removed by removing the respectives of the post constituent members Aa constituting the tower post A.

Further, according to the tower-like transfer device, the upper post portion A" is provided with the discharge port Ab for an object of transfer from the transfer means D installed to the tower post A whereby even if the tower post A constituting the tower-like transfer device is extended or contracted, various objects of transfer which are transferred in the tower post A can be discharged and used from the discharge port Ab always staying in the same direction, or can be brought in and transferred thereinto.

According to the tower-like transfer device, the transfer means D provided in the tower post A is the transfer means D for the freshly mixed concrete H. the lift B is provided with the boom F which is swiveled horizontally, the boom F is provided with the belt conveyor device G. the freshly mixed concrete H which has been brought up by the transfer means D, is transferred from the discharge chute 105 provided to the discharge port Ab of the tower post A to the rotary feeder J installed to above the boom F and the freshly mixed concrete H is transferred from the rotary feeder J to the conveyor belt 130 in the belt conveyor device G. Accordingly, the freshly mixed concrete H can smoothly be supplied successively from the lower portion of the tower-like transfer device to higher portion and to all the portions within the range where the boom F installed to the tower-like transfer device can swivel, whereby relocation of transfer devices or the like such as a bucket or the like is not necessary either in extending the tower post A and in contracting thereof accompanied by the partial removal.

I claim:

1. A tower-like transfer device comprising:

a cylindrical tower post including an upper post portion and a lower post portion constituted by connecting post constituent members;

a lift installed liftably to the tower post;

an upper post lifting means for lifting the upper post portion in integrating an additional post constituent member between the upper post portion disconnected from the lower post portion and the lower post portion and holding the upper post portion disconnected from the lower post portion in removing the additional post constituent member at an upper end of the lower post portion; and a transfer means installed liftably to said upper post portion, for lifting an object of transfer through an interior of said tower post to a discharge port provided in said upper post portion, said transfer means being configured to transfer freshly mixed concrete, wherein the lift is provided with a horizontally swiveling boom and the boom is provided with a belt conveyor device;

wherein the freshly mixed concrete transferred by the transfer means is transferred from a discharge chute installed at a discharge port of the tower post to a rotary feeder installed above the boom and the freshly mixed concrete is transferred from the rotary feeder to a conveyor belt in the belt conveyor device.

2. The tower-like transfer device according to claim 1, wherein said discharge port is configured for discharging an object of transfer from the transfer means.

3. A tower-like transfer device comprising:

a cylindrical tower post including an upper post portion and a lower post portion constituted by a plurality of connected post constituent members;

a lift installed liftably to the tower post;

an upper post lift configured for lifting and thereby disconnecting the upper post portion from the lower post portion;

an integration device configured to integrate an additional post constituent member with said lower post portion by inserting said additional post constituent member between said upper post portion and said lower post portion, thereby extending said lower post portion; and an object transfer device installed liftably to the tower post said object transfer device including a transfer lift provided at an upper end of said upper post portion, said object transfer device configured to lift an object of transfer through an interior of said cylindrical tower post.

4. A tower-like transfer device comprising:

a cylindrical tower post including an upper post portion and a lower post portion constituted by connecting post constituent members;

a lift installed liftably to the tower post;

an upper post lifting means for lifting the upper post portion in integrating an additional post constituent member between the upper post portion disconnected from the lower post portion and the lower post portion and holding the upper post portion disconnected from the lower post portion in removing the additional post constituent member at an upper end of the lower post portion; and a transfer means installed liftably to the tower post;

wherein the upper post portion is provided with a discharge port for discharging an object of transfer from the transfer means;

wherein the transfer means is configured for transferring freshly mixed concrete, wherein the lift is provided with a horizontally swiveling boom and the boom is provided with a belt conveyor device; and wherein the freshly mixed concrete transferred by the transfer means is transferred from a discharge chute installed at a discharge port of the tower post to a rotary feeder installed above the boom and the freshly mixed concrete is transferred from the rotary feeder to a conveyor belt in the belt conveyor device.

* * * * *